US010813445B2

(12) United States Patent
Filho et al.

(10) Patent No.: US 10,813,445 B2
(45) Date of Patent: Oct. 27, 2020

(54) BRUSH DRYING AND STORAGE APPARATUS

(71) Applicant: Sigma Enterprises, LLC, New Brighton, MN (US)

(72) Inventors: Rene Xavier Filho, Fort Lauderdale, FL (US); Simone Rodrigues Oliveira Xavier, Fort Lauderdale, FL (US)

(73) Assignee: Sigma Enterprises, LLC, Mendota Heights, MN (US)

( * ) Notice: Subject to any disclaimer, the term of this patent is extended or adjusted under 35 U.S.C. 154(b) by 1068 days.

(21) Appl. No.: 14/564,225

(22) Filed: Dec. 9, 2014

(65) Prior Publication Data

US 2015/0128444 A1 May 14, 2015

Related U.S. Application Data

(63) Continuation-in-part of application No. 13/104,455, filed on May 10, 2011, now Pat. No. 8,904,592.

(51) Int. Cl.
*A46B 15/00* (2006.01)
*A46B 17/04* (2006.01)

(52) U.S. Cl.
CPC ..... *A46B 15/0095* (2013.01); *A46B 17/04* (2013.01); *A46B 2200/202* (2013.01)

(58) Field of Classification Search
CPC ..... A46B 17/04; A46B 15/0095; A46B 2200/202; A46B 9/08; A46B 9/12; A46B 3/12; A46B 7/04; A46B 15/00
USPC ..... 15/168
See application file for complete search history.

(56) References Cited

U.S. PATENT DOCUMENTS

| | | | | |
|---|---|---|---|---|
| 530,386 | A | 12/1894 | Boeckh, Jr. | |
| 634,570 | A | 10/1899 | Briggs | |
| 663,838 | A * | 12/1900 | White | A47F 5/02 211/70 |
| 816,793 | A | 4/1906 | Harris | |
| 1,359,650 | A | 11/1920 | Amis | |
| 2,263,119 | A | 11/1941 | Cornell | |
| 2,485,068 | A | 10/1949 | Santana | |

(Continued)

OTHER PUBLICATIONS amazon.com, "Insten Cable Wire Cord Clips Organizer . . .", Accessed Feb. 11, 2016. Earliest Review Oct. 27, 2012. (http://www.amazon.com/Insten-Organizer-Computer-Desktop-6-pieces/productreviews/B00705H17M/ref=cm_cr dp_see_all_btm?ie=UTF8 &showViewpoints=1 &sortBy=recent).

(Continued)

*Primary Examiner* — Robert J Scruggs
(74) *Attorney, Agent, or Firm* — Dorsey & Whitney LLP

(57) ABSTRACT

An apparatus is provided for drying and storing brushes, each having a handle and a bundle of bristles extending therefrom. The apparatus comprises a base or sleeve retention member supporting a plurality of elastic sleeves configured to surround one of the bundles of bristles in a conforming and radially compressive relationship, and a brush retention member supporting a plurality of brush retainers configured to retain the respective brush handles. A support rod or post member connects the base and brush retention members in a spaced relationship in a longitudinal direction along the brush handles, with the brush handles retained in the brush retainers and the respective bundles of bristles positioned for engagement with the elastic sleeves.

18 Claims, 16 Drawing Sheets

(56) References Cited

U.S. PATENT DOCUMENTS

| | | | | |
|---|---|---|---|---|
| 2,963,150 | A | 12/1960 | Dgetluck | |
| D195,072 | S | 4/1963 | Kolarik | |
| 3,325,847 | A | 6/1967 | Meranto | |
| 3,749,233 | A | 7/1973 | McCormick, Jr. | |
| 4,129,918 | A | 12/1978 | Lee | |
| D286,093 | S | 10/1986 | Caller | |
| D300,266 | S | 3/1989 | Lane | |
| 4,847,939 | A | 7/1989 | Derencsenyi et al. | |
| 4,871,074 | A * | 10/1989 | Bryson | A45D 20/12 211/26 |
| 4,884,701 | A * | 12/1989 | Nymark | B25H 3/04 211/69.8 |
| D341,276 | S | 11/1993 | Jones | |
| 5,427,239 | A | 6/1995 | Hunt | |
| 5,543,194 | A | 8/1996 | Rudy | |
| D376,309 | S | 12/1996 | Takai | |
| 5,687,444 | A | 11/1997 | Hakker | |
| D395,815 | S | 7/1998 | Walters et al. | |
| D406,749 | S | 3/1999 | Selk | |
| D421,318 | S | 2/2000 | O'Brien et al. | |
| 6,199,695 | B1 | 3/2001 | Takeo | |
| D439,828 | S | 4/2001 | Kiely et al. | |
| D454,012 | S | 3/2002 | Chen | |
| D455,925 | S | 4/2002 | Carlson et al. | |
| D470,937 | S | 2/2003 | Gary et al. | |
| D480,938 | S | 10/2003 | Whitley | |
| 6,752,267 | B2 | 6/2004 | MacPherson et al. | |
| D508,842 | S | 8/2005 | Paolini | |
| 7,140,061 | B2 * | 11/2006 | Baker | A46B 17/04 15/168 |
| D544,264 | S | 6/2007 | Gallagher | |
| 7,234,602 | B2 * | 6/2007 | Roberti | B44D 3/12 211/65 |
| D568,254 | S | 5/2008 | Patchett et al. | |
| D587,564 | S | 3/2009 | Kodi | |
| D597,403 | S | 8/2009 | Ho et al. | |
| D601,879 | S | 10/2009 | Kim et al. | |
| D621,693 | S | 8/2010 | Dong | |
| D634,566 | S | 3/2011 | Gonnelli | |
| D644,501 | S | 9/2011 | Chen | |
| D652,517 | S | 1/2012 | Weaver | |
| D674,271 | S | 1/2013 | Rodwin | |
| D680,773 | S | 4/2013 | Tebbe et al. | |
| D691,032 | S | 10/2013 | Chen | |
| D691,873 | S | 10/2013 | Ganski | |
| D691,876 | S | 10/2013 | Ganski | |
| D691,877 | S | 10/2013 | Ganski | |
| D701,000 | S | 3/2014 | DiGirolamo et al. | |
| 8,904,592 | B1 * | 12/2014 | Filho | A46B 17/04 15/168 |
| D733,534 | S | 7/2015 | Altrichter | |
| D733,535 | S | 7/2015 | Egami | |
| D741,149 | S | 10/2015 | Koop et al. | |
| D764,709 | S | 8/2016 | Filho et al. | |
| D766,511 | S | 9/2016 | Filho et al. | |
| 2001/0042281 | A1 | 11/2001 | Forsline | |
| 2004/0099624 | A1 | 5/2004 | Hein | |
| 2004/0025084 | A1 | 12/2004 | Baker et al. | |
| 2004/0250840 | A1 | 12/2004 | Baker et al. | |
| 2007/0056130 | A1 | 3/2007 | Baker et al. | |
| 2007/0151573 | A1 | 7/2007 | Christian | |
| 2014/0250840 | A1 | 9/2014 | Bradford | |
| 2014/0325779 | A1 * | 11/2014 | Dansby | A46B 17/02 15/168 |
| 2014/0332642 | A1 * | 11/2014 | Lim | A46B 17/04 248/111 |
| 2015/0128444 | A1 | 5/2015 | Filho et al. | |

OTHER PUBLICATIONS

Amazon.com, "W-Tool Nail Art Pen Pot Brush Cleaner Holder," cited in related design U.S. Appl. No. 29/511,242 dated Feb. 8, 2016 (http://www.amazon.com/W-Tool-Nail-Brush-Cleaner-Holder/dp/B00FNFZHGY/ref=sr_1_92?s=arts-crafts&ie=UTF8&qid=1453927326%sr=1-92&keywords=brush+holder), 3 pages.

Cloud10beauty.com, "Sigma Beauty Dryn Shape Tower Full Set," cited in related design U.S. Appl. No. 29/511,242 dated Feb. 8, 2016 (http://www.cloud10beauty.com/sigma-beauty-dry-n-shape-tower-full-set.html), 3 pages.

"Caring for your Make-Up Brushes." Basic MakeUp and Anti Aging Products. 4 pages. Obtained Oct. 27, 2011 from <http://www.basicmakeup.com/make-up-brushes/>.

"Cosmetic Brushes." Basic MakeUp and Anti Aging Products. 4 pages. Obtained Oct. 27, 2011 from <http://www.basicmakeup.com/cosmetic-brushes/>.

"Makeup Brush Cleaning." 3 pages. Obtained Oct. 27, 2011 from <http://makeup.beautyhill.com/makeup-brush-cleaning.html/.

"The Brush Guard." 2 pages. Obtained Oct. 27, 2011 from <http://www.thebrushguard.com/use.html>.

Extended European Search Report received for European Patent Application No. 15160359.4, dated Apr. 6, 2016, 7 pages.

* cited by examiner

BRUSH DRYING AND STORAGE APPARATUS

CROSS-REFERENCE TO RELATED APPLICATION

This application relates to U.S. patent application Ser. No. 13/104,455, COMPRESSIVE DRYING OF FINE-BRISTLED BRUSHES, filed May 10, 2011, issuing Dec. 9, 2014, as U.S. Pat. No. 8,904,592 B1, which is incorporated by reference herein, in the entirety and for all purposes.

BACKGROUND

The present disclosure relates to the care and maintenance of brushes, and more particularly to devices and systems for promoting a more rapid drying of the bundled bristles of a brush while preserving a desired shape of the bundled bristles.

Since at least the early part of the nineteenth century, bristle brushes have been used to apply paint and other relatively viscous liquids to the surfaces of a wide variety of substrates. The basic brush includes a handle, a plurality of natural or synthetic bristles, and a ferrule, typically metal, for mounting the bristles to one end of the handle. The bristles are mounted as a bundle, tightly packed at the ferrule and extending away from the ferrule in the handle length direction. Depending on the brush style, the bristles are either substantially parallel, or flared in the sense of including centrally located bristles extending lengthwise and peripheral bristles slightly inclined outwardly as they extend away from the ferrule.

In either event, the bundle is composed of multiple bristles, and multiple interstitial regions or open spaces between and among the bristles. The interstitial regions tend to be elongate in the direction of the bristles, and tend to enlarge as they approach the free ends of the bristles, due either to a flaring of the bundle or to a natural taper of the bristles to pointed free ends. The interstitial regions cooperate to provide a reservoir that receives and holds the paint or other viscous substance, then releases the substance as the bundle of bristles is drawn across the surface of a substrate.

Cosmetic brushes generally are formed with considerably finer bristles than paint brushes, and are used to apply a variety of cosmetics including eyeliner, eye shadow, blush, bronzer, and concealer, in liquid and powdered form. As with other brushes, the interstitial regions in the bristle bundle of a cosmetic brush provide a reservoir for the cosmetic, releasing the cosmetic as the brush is drawn across the user's skin. Brushes used for artistic painting are quite similar to cosmetic brushes, and typically employ similar bristles.

Proper maintenance of brushes requires thorough cleaning of the bristles. In the case of paint brushes, the most obvious requirement is to avoid an accumulation and drying of paint in the interstitial regions, which hardens the bristles and ruins the brush. Cosmetic brushes are also subject to this requirement. Further, because they are used to apply substances to the skin, cosmetic brushes are subject to the risk of skin irritation due to a buildup of previously applied cosmetics and foreign matter. Accumulated makeup products can harbor bacterial growth which can be harmful to the skin.

Accordingly, careful users endeavor to clean brushes thoroughly, directly after use. Paint brushes typically are cleaned with low viscosity liquids such as water or paint thinner. Cosmetic brushes frequently are cleaned with water mixed with soap, shampoo, or vinegar, followed by a water rinse. Wetting the bristles leaves them highly compliant, and care must be taken to preserve the desired shape of the bundle of bristles as drying proceeds. To this end, U.S. Pat. No. 4,847,939 (Derencsenyi et al.) discloses a resilient sleeve, preferably formed of PVC, polyethylene or polypropylene. The sleeve covers the bristles, the stock and part of the handle and is formed with slots or other openings that allow passage of air or moisture to aid the drying. U.S. Pat. No. 6,199,694 (Van Diest et al.) discloses a plastic sheath with halves that resiliently flex to allow insertion and removal of the brush. The sheath is provided with vent holes to hasten drying. In U.S. Pat. No. 1,359,650 (Amis), a shaving brush holder is formed as a rubber tube that supports the shaving brush vertically. Perforations through the tube allow passage of air and moisture, although the primary purpose of the holder is said to be protecting items near the shaving brush and holder to exposure to moisture from the wet brush.

According to another approach intended to protect submerged bristles, U.S. Pat. No. 2,263,119 (Cornell) provides a perforated casing to surround a brush when submerged in a brush preservative fluid. Similarly, U.S. Pat. No. 816,793 (Harris) discloses a cup shaped holder containing a brush cleaning liquid. A ring at the top of the holder is designed to suspend the bristles in the liquid, maintaining the bush in a vertical orientation while keeping the weight of the handle off of the bristles.

U.S. Pat. No. 7,140,061 (Baker et al.) discloses a bristle preservation system directed to fine-bristled brushes, more particularly artists' brushes. The system includes an elastically deformable braided tube formed of helically wound filaments. The tube undergoes axial elongation and radial contraction (or vice versa) simultaneously in the manner of a stent or Chinese handcuff. The tube is sufficiently long to extend beyond the tips of the bristles while also surrounding and bearing against at least part of the ferrule. The tube is said to be stable enough to hold the handle and bristles in a vertical orientation with the bristles pointing down.

The forgoing devices, although useful in certain applications, rely on convective and gravitational transfer of moisture. Thus, while tending to protect the bristles during drying to preserve the desired shape, they are unlikely to increase the rate of drying, and in some cases may even increase the drying time. Accordingly, they do not effectively address circumstances that limit the time available for drying—for example, a travel schedule with brief stays at different locations, where leaving brushes out to dry for an extended time may be difficult or impossible.

SUMMARY

This disclosure is directed to a brush drying device and storage apparatus.

DETAILED DESCRIPTION

Figure 1:
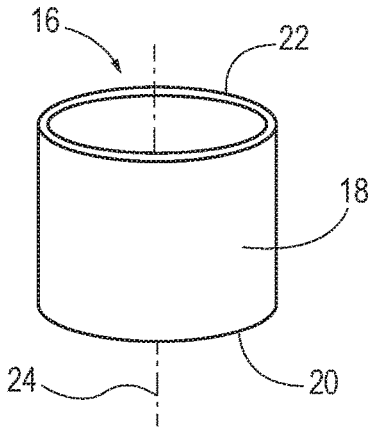
FIG. 1 is a perspective view of a bristle shaping and drying device.

The present disclosure relates to brush care and maintenance, and describes:

- a device capable of applying substantial radially inward pressure when surrounding the bristles of a brush, to promote a more rapid drying of the bristles while more effectively preserving or restoring the desired bristle shape;
- a bristle drying system that relies on a moisture transfer mechanism other than convection or gravity, to substantially increase the rate of drying;
- a moisture permeable cover for a bundle of bristles, capable of rapidly drying and effectively shaping the bristles without requiring a vertical orientation or suspension of the brush; and
- a system for storing multiple brushes, capable of promoting rapid drying and proper shaping of the brushes when stored.

More specifically, there is provided a bristle drying and shaping assembly. The assembly includes a brush comprising a handle elongate in a longitudinal direction, and a plurality of bristles. A ferrule at a distal end of the handle supports the bristles with respect to the handle in a generally longitudinal extension away from the distal end to form a bundle composed of the bristles and interstitial regions between and among the bristles. The assembly further includes a tubular band disposed on a band axis. The tubular band has a nominal band diameter less than a diameter of the bundle when in a contracted state, and is extensible elastically along a circumference thereof to a radially expanded state to accommodate the bundle. The tubular band surrounds the bundle with the band axis oriented substantially in the longitudinal direction and in the radially expanded state, to produce an elastic restoring force acting radially inwardly to compress adjacent ones of the bristles against one another to substantially close the interstitial regions.

Compressing the bristles into contact with one another substantially reduces the volume of the interstitial regions, individually and collectively. As these regions diminish in volume, the water or other liquid or material they contain is forced to percolate through the bundle, migrating radially outward and axially or longitudinally toward the free ends of the bristles. The inward pressure or squeezing of the bristles together, plus a diffusion mechanism as the moisture seeks the drier ambient environment, are believed to cause what constitutes a surprisingly large reduction in the time required to fully dry the bundle of bristles.

In exemplary versions of the assembly, the tubular band when surrounding the bristles is disposed distally of the ferrule, and has an axial dimension sufficiently short to leave distal end portions of the bristles exposed when the band surrounds the bundle. The spacing from the ferrule enables the band to more effectively apply pressure to, and conform to, the bundle of bristles. The exposure of distal regions of the bristles promotes moisture loss through evaporation.

In additional examples, the tubular band is composed of intercalated fibers including circumferential fibers and axial fibers. Fibers extending circumferentially along the tubular band are resilient, while the axially extending fibers are substantially inextensible. As a result, the tubular band is expanded circumferentially (or radially) to accommodate the bundle of bristles, and then contracts circumferentially as it compresses the bundle. Meanwhile, the axial dimension of the band remains substantially constant. As compared to braided tube designs in which a radial contraction is accompanied by axial elongation, a tubular band formed according to this aspect of the disclosure more readily conforms to the bristles without unwanted axial movement relative to the bristles. The preferred tubular band also can expand and contract radially when surrounding the bundle of bristles, without exerting unwanted axial forces against the bristles.

An exemplary brush support and drying system includes a handle retainer attached to a brush retention member. The retainer is adapted for a contiguous engagement with a handle of a brush to contain the handle with respect to the structure. A tubular band or drying sleeve is attached to a sleeve retention member, aligned with and axially spaced apart from the retainer member with a connecting member therebetween. The tubular band has a nominal band diameter in a contracted state, and is elastically extensible in a circumferential direction to accommodate a bundle of bristles of the brush by surrounding the bristles, thereby cooperating with the retainer to secure the brush. The tubular band is adapted to generate an elastic restoring force when surrounding the bundle of bristles. The restoring force acts radially inwardly against the bundle and is of sufficient magnitude to compress the bristles against one another to substantially close interstitial regions between and among the bristles.

The brush and sleeve retention members afford convenient storage for the brush, or several such brushes when provided with additional pairs of the tubular bands and retainers, for example circumferentially arranged about the sleeve and brush retention members, respectively. In one version, the members form a tower structure, for example a vertically oriented tower structure with the connecting frame member disposed in an axial direction between the retainer frame member and the drying frame member. In such embodiments, a plurality of the tubular bands or sleeves on the sleeve retention member can be arranged spaced apart in the axial direction from a similar plurality of retainers on the brush retention member (e.g., in a longitudinal direction, along the brush handles).

The tubular bands or sleeves and retainers can be provided in different sizes, in order to accommodate a variety of differently sized brushes. In further examples, a second set of brush and sleeve retention members can be attached to the first set, forming a modular, stackable tower assembly for brush drying and storage. Pairs of the tubular members and retainers are formed along each of the sets of sleeve and brush retention members, and each set of retainer, drying and connecting frame members forms a stackable, modular tower element. When stacked in the axial or vertical direction, each module stores a number of brushes secured by and between the axially aligned pairs of retainers and elastic sleeves or tubular members.

In various additional embodiments, a device for drying and shaping bristles of a brush includes a resilient, moisture permeable tubular member or drying sleeve disposed about a tube axis and having a nominal diameter in a contracted state. The drying sleeve is elastically extensible in the circumferential direction to allow placement of the sleeve in surrounding contiguous relation to a bundle of bristles, e.g., on a brush. The bundle is composed of a plurality of bristles extending generally in a longitudinal direction, with interstitial regions between and among the bristles, and the sleeve axis extending substantially in the longitudinal direction. In the surrounding contiguous relation with the bundle of bristles, the sleeve produces an elastic restoring force acting radially inwardly against the bundle and of sufficient magnitude to radially compress the bristles against one another to substantially close the interstitial regions.

The bundle of bristles typically extends generally distally from the brush handle, for example being mounted to the handle with a ferrule, and is surrounded by the resilient, moisture permeable tubular member or drying sleeve, having an axis substantially aligned with the bristles. While conforming to the shape of the bundle, the drying sleeve compresses the bundle radially inwardly due to its elastic restoring force, substantially closing the interstitial regions between and among the bristles. This results in a highly favorable combination of reduced bristle drying times, and restoration or preservation of the desired bundle shape. The shorter drying times enable users to clean their brushes under circumstances that would not allow sufficient time under conventional approaches. In addition, several of the tubular members can be paired with brush handle retainers mounted to a suitable frame member or other structure, forming a more convenient drying and storage apparatus that can accommodate several brushes of different sizes, for example in a modular tower form configured for drying, shaping and storing the brushes.

Tubular Member and Drying Sleeve Configurations

FIG. 1 a perspective view of a bristle drying and shaping device in the form of a tubular member or drying sleeve 16. The sleeve has a wall 18 substantially uniform in size and thickness along its axial length running from a proximal end 20 to a distal end 22, vertically as viewed in the FIG. 1. The sleeve is disposed about a vertical sleeve axis 24.

Figure 2:
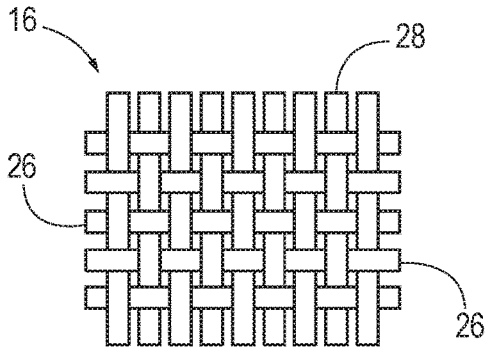
FIG. 2 is a side elevation of the device.

FIG. 2 is a side view of sleeve 16, formed of two sets of intercalated fibers: circumferentially extending fibers 26 which appear horizontal in FIG. 2, and axially extending fibers 28 which appear vertical or transverse to circumferentially extending fibers 26. Circumferential fibers 26 and axial fibers 28 can be natural, e.g. cotton, or synthetic, e.g. polyester. In some examples, the fibers are of two different types. For example, the circumferential fibers may be elastic, and accordingly allow elongation or expansion of wall 18 along its circumference. The axial fibers may be substantially inextensible, and provide structural support for the circumferential fibers.

Figure 3:
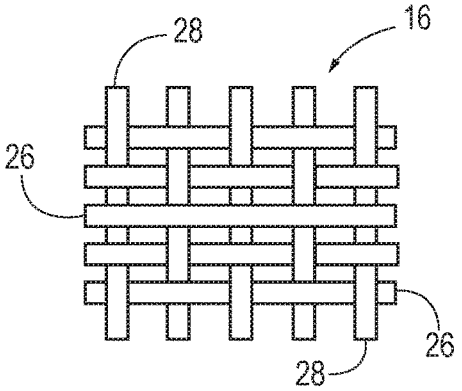
FIG. 3 is a side elevation of the device in a radially expanded state.

The combination of elastic circumferential fibers and substantially inextensible axial fibers can govern the elastic expansion of sleeve 16 when subject to external forces. In particular, sleeve expansion may occur generally or almost exclusively in the radial and circumferential directions. This is apparent from a comparison of FIGS. 2 and 3, showing wall 18 in a relaxed state and an elastically enlarged state, respectively. In the contracted or relaxed state, assumed by the sleeve when subject to no substantial external forces, adjacent fibers are close together and spaces between them may not be visible to the naked eye. In the expanded state of the sleeve such spaces may be visible, for example due to a substantial increase in circumferential spacing between adjacent axial fibers. The axial distance between adjacent circumferential fibers may also increase slightly, due to a decrease in the diameter of fibers 26 as they are elongated in the circumferential direction. Thus, the elastic expansion of sleeve 16 may be asymmetrical, in the sense that the axial dimension remains substantially stable as the diameter and circumference are enlarged.

Figure 4:
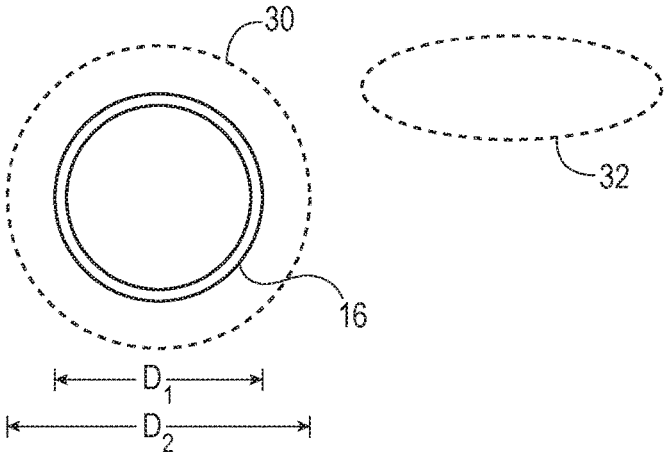
FIG. 4 is a top view of the device, showing the radially expanded state and a non-circular relaxed state in broken lines.

FIG. 4 is a top view of sleeve 16 with a nominal diameter $D_1$ in the relaxed state. When surrounding the bundle of bristles on a brush and accordingly subject to a radially outward force exerted by the bundle, wall 18 is expanded to a radially enlarged state and has a diameter $D_2$. The larger diameter $D_2$, shown at 30, will vary with the compacted diameter of the bundle of bristles surrounded by the sleeve.

In some examples fibers 26 and 28 are compliant, which results in a compliant sleeve configuration. While sleeve 16 tends to assume the circular profile shown in FIG. 1 when the sleeve axis is vertically disposed, it can also tend toward an elliptical profile, in some cases representing an extreme ellipse or a flattened "doubled over" appearance when placed on a surface with axis 24 substantially horizontal. Such a profile is shown in FIG. 4 at 32. The capability to assume a substantially flat configuration contributes to the ease of storing the sleeve, and does not interfere with its performance.

Sleeve 16 is water permeable when surrounding the bristles of a brush, to avoid interfering with evaporative removal of moisture from the bristles. Accordingly, it is advantageous to select circumferential and axial fibers that are water permeable. Alternatively, sleeve 16 can be formed with water impermeable versions of either fibers 26 or fibers 28, or both, with reliance placed on the porosity created by the separation of adjacent fibers, especially separation of the axial fibers, in the expanded sleeve. In one version of sleeve 16, the circumferential fibers and the axial fibers are formed of mercerized cotton.

Figure 5C:
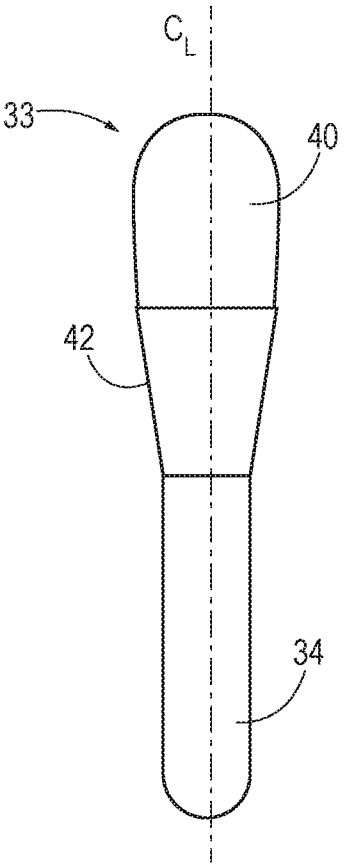
FIG. 5C is a side elevation of the brush following removal of the device.
Figure 5B:
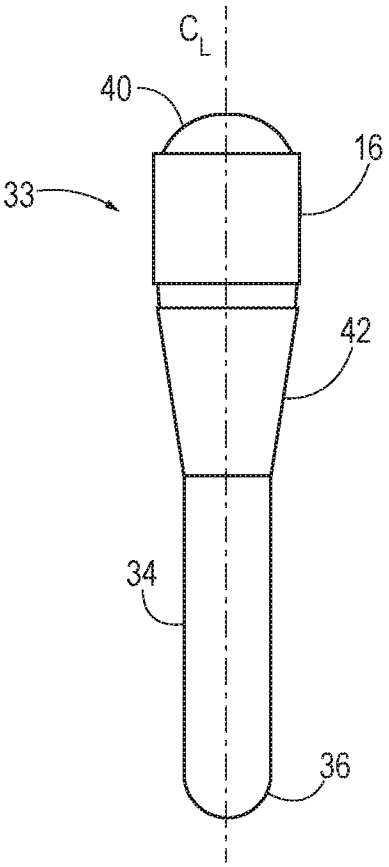
FIG. 5B is a side elevation of the brush in combination with the device.
Figure 5A:
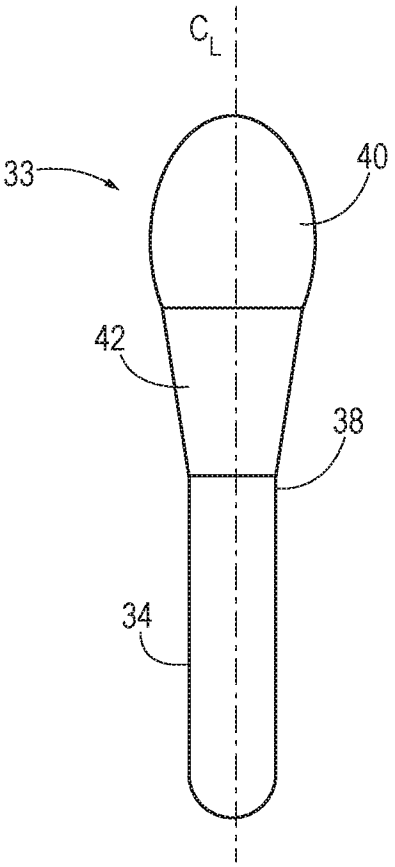
FIG. 5A is a side elevation of a brush.

FIG. 5A is a side elevation of a brush 33. Sleeve 16 is suited for protecting the fine bristles used in, e.g., cosmetic brushes 33 and artists' brushes 33, while promoting a more rapid drying of the bristles after cleaning.

In FIG. 5A, brush 33 is shown after use and shortly after cleaning, with the bristles still wet. An exemplary brush 33 includes an elongate handle 34 having a proximal end region 36 and a distal end region 38 separated along a centerline or brush axis direction $C_L$, with multiple natural or synthetic bristles arranged in a bundle 40 and a ferrule 42 surrounding the handle and the proximal ends of the bristles. The ferrule compacts the bristles, and supports bundle 40 with respect to handle 34 by virtue of connection to the handle. Bundle 40 may be flared, in the sense that the more centrally located bristles extend in the longitudinal direction generally parallel to the handle axis, while the more peripheral bristles are inclined outwardly in the radial direction. Nonetheless, all of the bristles may extend at least generally in the longitudinal direction. After brush 33 is cleaned, the amount of flair may exceed a desired or designed level, due to an increase in fairing during usage or due to the wetting and handling of the bristles during cleaning.

FIG. 5B is a side elevation of a brush 33 in combination with sleeve 16. To promote rapid drying and preserve or restore the intended shape of bundle 40, sleeve 16 is installed onto bundle 40, surrounding the bundle as shown in FIG. 5B. Due to the direction of the bristles, sleeve 16 is installed by placing it over proximal end region 36 of handle 34, then sliding the sleeve distally over handle 34 and ferrule 42 until sleeve 16 is disposed about the bristles and ferrule, or disposed about the bristles proximate or adjacent but spaced apart distally from the ferrule. The initial placement and sliding of sleeve 16 along handle 34 typically are accomplished with sleeve 16 in the relaxed state, although a larger diameter handle might require radial enlargement. In either event, the sleeve is radially enlarged as it is moved distally along ferrule 42 and over the bristles. This is because nominal diameter $D_1$ is less than the diameter of bundle 40, even at the proximal portion of the bundle compressed by the ferrule.

As sleeve 16 continues to move distally onto and along bundle 40, the sleeve and bundle act upon one another and conform to one another in profile. The bundle elastically expands sleeve 16 along its circumference, at a level that initially increases due to the flair of the bundle. This tendency, however, is counteracted by the sleeve, which exerts a radially inward force against bundle 40 that tends to reduce the size of the bundle. In equilibrium, the forces of the bundle and sleeve counterbalance one another. A larger flair causes a larger circumferential or radial expansion of the sleeve, increasing the elastic restoring force, which in turn increases the tendency to compact the bundle and thereby reduce its radius.

One possible result, shown in FIG. 5B, is a compaction of bundle 40 to form straight sides, with substantially all of the bristles extending in the longitudinal direction, generally parallel to brush axis or centerline $C_L$. The actual shape caused by the sleeve varies, from a slight retention of the outward flare, to a convergence of bundle 40 in the distal direction. In all cases, the circumferential elastic restoring force in sleeve 16, and therefore the radially inward force exerted by the sleeve, is sufficient to compact the bristles, i.e. to bring adjacent bristles firmly against each other to substantially close the interstitial open regions between and among the bristles present when the bundle is not subject to the radially compressive force of the sleeve.

FIG. 5C is a side elevation illustrating brush 33 after drying, and after removal of sleeve 16. Again due to the bristle direction, the sleeve may be removed by sliding it distally relative to bundle 40. The brush shaping impact of the sleeve is illustrated by the generally parallel longitudinal sides of the bundle, oriented substantially along centerline $C_L$ of the brush handle, although actual results will vary.

The sleeve, when surrounding the bundle of bristles, is configured to compact the bristles against one another and thereby substantially close the interstitial regions between and among the bristles. In conventional open air drying, and in drying with the aid of devices that cover or surround the bristles yet purport to rely on gravity to remove moisture, convection is the mechanism primarily relied upon to remove moisture from the bristles. The radial compaction of the bristles in accordance with the present disclosure is counterintuitive in the context of conventional approaches, because bristle compaction removes or diminishes pathways otherwise available for convection.

This notwithstanding, the use of sleeves similar to sleeves 16 has been found to considerably reduce drying times while restoring or preserving the shape of the bristles. The substantial closure of interstitial regions between and among bristles may, however, require a high level of radially inward force to compact the bundled bristles, well beyond levels found in previous approaches.

Figure 6:
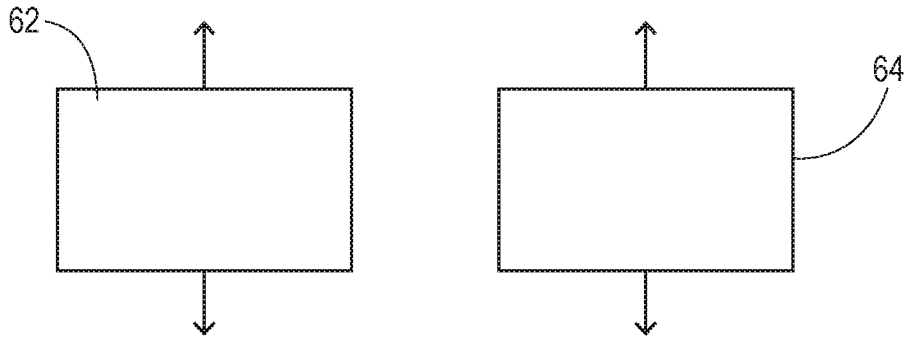
FIG. 6 is a side view schematically representing a comparative test of circumferential sleeve elongation under an applied force.
Figure 7:
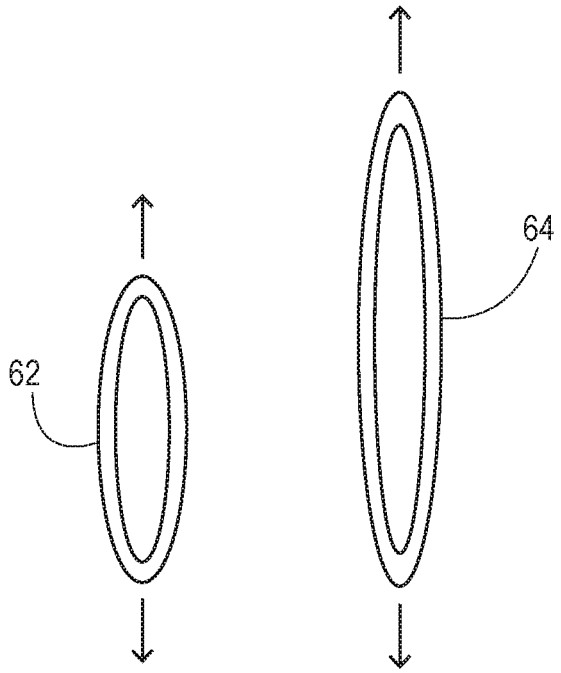
FIG. 7 is an end view representing the comparative elongation test of FIG. 6.

FIGS. 6 and 7 schematically illustrate side and end views, respectively, of a comparative test conducted on a tubular device or sleeve 62, constructed in accordance with the present disclosure, and a prior art tubular device or sleeve 64. Each of the devices was subjected to a radially outward force of the same magnitude, in this case 20 oz. The force was applied along the length of each device, at a location centered between the opposite ends. The results are indicated in Table 1.

TABLE 1

Comparative Test of Circumferential Elongation

| | Device 62 | Device 64 |
|---|---|---|
| Relaxed State Diameter | 2.6 cm | 2.0 cm |
| Diameter-Force Applied | 2.7 cm | 4.8 cm |
| Profile Expansion | 0.1 cm | 2.8 cm |

As seen from FIGS. 6 and 7, the radially outward force was exerted against two sections of the tube wall simultaneously. The force applied to sleeve 62 caused an elongation of 0.1 cm, about 3.8 percent of the unstressed diameter. The same force, applied to sleeve 64, caused an enlargement of 2.8 cm, or 140 percent of the original size.

Sleeve 64 exerts a finite radially inward force against the bristles, sufficient to frictionally engage the bristles so that a portion of the tube that extends distally beyond the bristles can support the weight of the entire brush in a vertical orientation. Generally, the radially inward force sufficient to compress the bristles for substantial closure of interstitial regions, exceeds the force necessary for frictional engagement by more than an order of magnitude.

In another comparative test, brushes with natural bristles and synthetic bristles were dried using sleeve 62 and sleeve 64, both in comparison with open air drying. Brushes were tested in six groups: (1) goat hair bristles dried using tube 62; (2) goat hair bristles dried using tube 64; (3) goat hair bristles, open air drying; (4) synthetic bristles dried using tube 62; (5) synthetic bristles dried using tube 64; and (6) synthetic bristles, open air drying.

The brushes were immersed in water for ten minutes. Each brush, immediately after removal from the water, was placed in contact with a highly absorbent paper for five minutes. The resulting "halo" formed by outward migration of water from the area of brush contact, was measured at its maximum diameter to obtain a halo width measurement. At that point, drying was initiated.

At four stages of drying (2 hours, 4 hours, 6 hours, and 24 hours), the halo forming and measuring step was repeated. The results are shown in Table 2.

TABLE 2

Drying Tests

| | | | Halo Width (cm) at Time (hours) | | | | |
|---|---|---|---|---|---|---|---|
| Group | Bristle Type | Method | 0 | 2 h | 4 h | 6 h | 24 h |
| 1 | Goat Hair | Sleeve 62 | 10 | 3.5 | 0 | 0 | 0 |
| 2 | Goat Hair | Sleeve 64 | 10.5 | 9.5 | 9 | 9 | 8.5 |
| 3 | Goat Hair | Open Air | 10 | 6.5 | 4.5 | 0 | 0 |
| 4 | Synthetic | Sleeve 62 | 12 | 5.5 | 3 | 0 | 0 |
| 5 | Synthetic | Sleeve 64 | 12 | 11 | 10 | 9 | 9 |
| 6 | Synthetic | Open Air | 12.5 | 8.5 | 7.2 | 7 | 0 |

As Table 2 indicates, in connection with the natural bristle brush dried using sleeve 62, no transfer of water to the absorbent paper was observed in the test conducted four hours after the initial wetting of the bristles. As to the synthetic bristle brush dried using sleeve 62 no such transfer was observed in the test conducted six hours after initial wetting. In both cases, the brush was found to be completely dry and ready to use.

In contrast, the natural and synthetic brushes dried using sleeve 64 remained wet 24 hours after initial wetting, although a reduction in halo diameters over time did suggest loss of moisture. The air dried natural brush left no observable water halo when tested six hours after initial wetting. However, the brush at this point still felt humid to the touch, and for that reason was considered not yet ready for use. The air dried synthetic bristle brush left no visible water halo in the test conducted 24 hours after initial wetting.

Overall, the results indicate a substantial reduction in drying time, for natural bristles and synthetic bristles alike, when the bundle of bristles is surrounded by a water permeable tubular member in an elastically enlarged state under an elastic restoring force sufficient to compress the bristles and thereby substantially close the interstitial regions ordinarily present between and among the bristles.

Thus in accordance with the present disclosure, systems and devices are provided to preserve and restore the shape of a bundle of bristles, after cleaning the brush. These systems and devices substantially reduce the time required for drying, so that cleaning and drying the brushes becomes more convenient. The devices and systems allow the cleaning and drying of brushes in circumstances where these activities were either difficult or impossible, due to previous drying time requirements.

Apparatus Configurations

Figure 8:
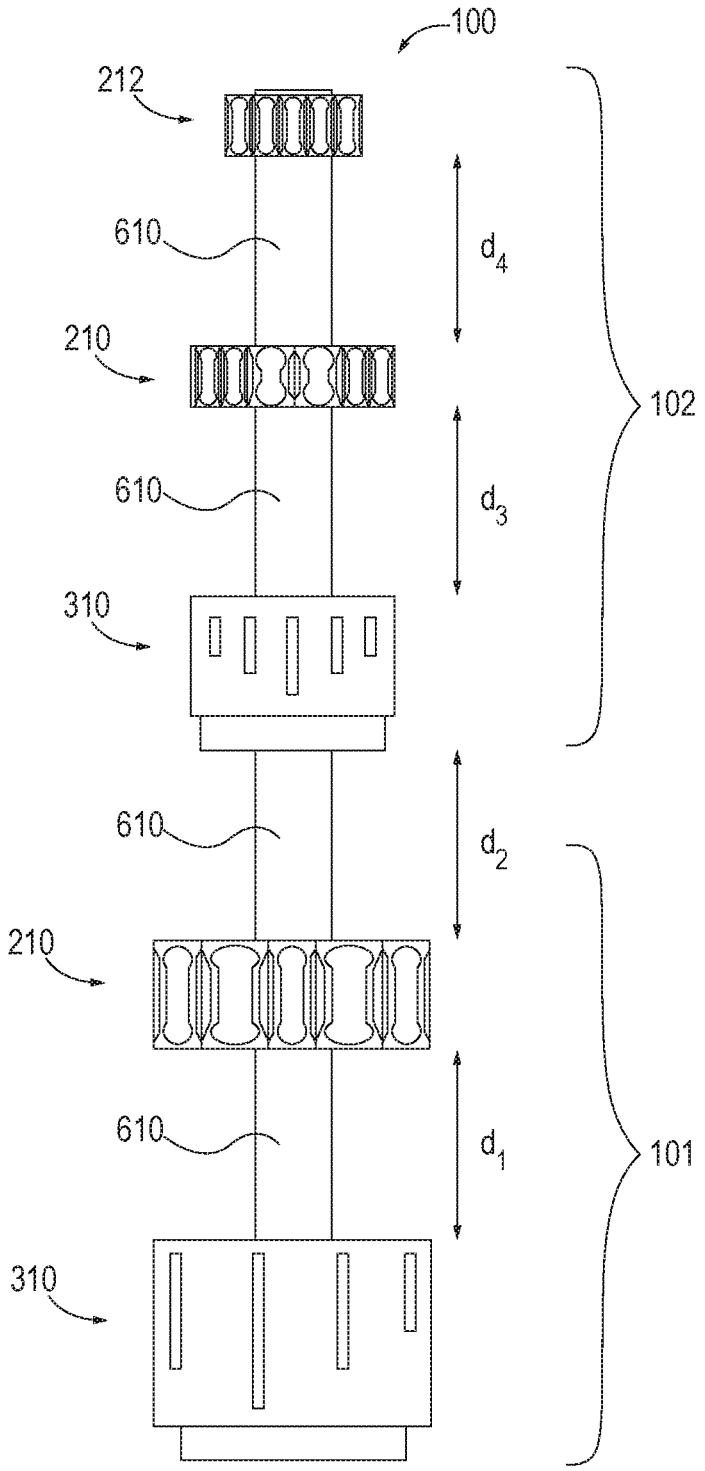
FIG. 8 is a side view of a brush drying and storage apparatus, in a tower embodiment.

FIG. 8 is a side view of an exemplary (e.g., modular) tower apparatus 100 for drying the bristles of a brush while preserving a desired bundle shape. Embodiments of tower 100 are suitable for drying and storage of brushes (for example, from a few up to twenty, forty or more brushes) in a relatively small space. The various pieces and components of tower 100 may be disconnected to allow for tower 100 to be disassembled and reassembled in different configurations or in separate modular components in order to suit particular needs. Tower 100 may also be constructed such that it securely holds the handles of a brush so the ferrule and bristles are on the bottom (e.g., with the brush upside down), allowing gravity to help eliminate excessive water by dripping, migration or flow to the bristle tip.

FIG. 8 is a side view of tower apparatus 100 with retention rings 210, 212 separated from base frame members or discs 310 via one or more continuous or discrete connecting frame members or posts 610. In this embodiment, retention ring 212 is located at the top end of tower 100, and disc member 310 is positioned at the lower end or base of tower 100. Lower retention ring 210 is positioned distance $d_1$ from (or above) lower base member 310, upper base member 310 is positioned distance $d_2$ from lower retention ring 210, middle retention ring 210 is positioned distance $d_3$ from upper base member 310, and upper retention ring 212 is positioned distance $d_4$ from ring 210, each retention and base frame element being thus longitudinally spaced along one or more connecting posts 610.

The particular number and configuration of retention rings 210, 212 and base members 310 are merely given as examples. Various embodiments may utilize different numbers and configurations frame members 310, for example in square, oblong, oval, rectangular, triangular or other form, coupled together by any number of continuous or discrete posts or other connecting frame members 610.

The construction of tower 100 may also be modular, for example with a first lower tower module 101 formed by lower base member 310 coupled to brush retention member 210 via support post 610, and a second upper tower module 202 formed by middle or intermediate base member 310 coupled to one or both of brush retention members 210 and 212 via one or more connecting rods or posts 610. Top and bottom modules 101 and 102 can be stacked upon one another, for example using an additional post 610 to couple intermediate base member 310 to brush retention member 210, or a single through-post configuration.

Individual base members 310 may have different forms and characteristics. For example, base members 310 may have shapes and properties similar to those of a disc-type base member 310, as described herein. Other forms and characteristics may be selected based on the selected location of base members 310 on tower apparatus 100. For example, where a base frame member 310 is located at the lower end or bottom of tower 100, base member 310 may have a generally larger size and greater mass than tower frame retention rings 210, 212 and other base members 310. Suitable base frame members 310 located at the bottom of tower 100, for example, may have a height of 10-100 mm (e.g., about 62 mm) and a diameter of 50-200 mm (e.g., about 92 mm). Suitable intermediate base members 310 located in the middle portion of tower 100 may have a height of 10-60 mm (e.g., about 40 mm) and a diameter of 30-100 mm (e.g., about 67-68 mm). Larger and smaller frame members 310 are also contemplated, depending on the overall configuration of apparatus 100, and the desired size and number of brushes to be dried and stored.

Other characteristics of base frame members 310 can also be chosen to promote stability of tower 100. For example, stability-enhancing features including feet or gripping members such as suction cups, fastener, adhesives, and other such features may be included on the bottom surface of either base member 310.

Brush retention members 210, 212 also have various forms and characteristics, for example with the properties of a ring-type brush retention member 210, as described herein. Additional characteristics can be selected based on the location of retention members 210, 212 on tower 100. For example, the height of individual retention rings 210, 212 may be 10-50 mm, e.g. about 36 mm, about 20 mm, about and 20 mm, respectively, where each ring member 210, 212 is located at an increasing longitudinal distance of height along a respective connecting post or rod 610. The diameters of brush retention members 210, 212 may also vary longitudinally along post 610. For example, individual retention rings 210, 212 may have diameters of 50-150 mm, e.g., about 92 mm, or about 68 mm, or about 45 mm.

Distances $d_1$, $d_2$, $d_3$ and $d_4$ between various brush retention members (or rings) 210, 212 and base members (or discs) 310 also vary, depending on considerations including, but not limited to, stability requirements and the intended uses of tower apparatus 100. For example, distances $d_1$, $d_2$, $d_3$, $d_4$ may all be substantially equal, as determined by a number of substantially uniform, discrete post members 610, or one or more individual distances $d_1$, $d_2$, $d_3$, $d_4$ may vary from the others, as defined along a particular post 610. Distances $d_1$, $d_2$, $d_3$, $d_4$ can also be selected or predetermined to match the height of a particular brush design, or configured such that retention members 210, 212 and base members 310 hold the handle and bristles of different brushes in a particular locations, when coupled together with connecting rods or posts 610 of suitable length. For example, the handles of the brushes may be retained by clips or other retention elements disposed about the perimeter of retention members 210, 212, so that the bristles are at or adjacent the locations of corresponding drying sleeves disposed about perimeter of base members 310, as described herein.

Support post 610 may have an elongate (e.g., cylindrical) shape that extends into or through one or more individual brush retention members 210, 212 and base members 310. For example, one end of a single post 610 may terminate in base member 310 and extend through members 310, 210 and 212 to an opposite end terminating in brush retention ring 212. Alternatively, individual connecting rods or posts 610 may extend through lower module 101 from lower base member or drying frame 310 through retention ring 210 to intermediate base member 310, and from intermediate base member 310 through retention ring 210 to top retention ring 212. In other embodiments, post or rod 610 may continue up past top retention ring 212, and/or down through base member 310. For example, the lower portion of post 610 may extend through base 310 and terminate in a tabletop, counter, or other surface, in order to provide greater stability for tower 100. Similarly, the upper portion of post 610 may terminate above top retention ring 212.

Rod and post members 610 take various forms, depending on the desired configuration and use of tower apparatus 100. In one configuration, individual rods and posts 610 have diameter smaller than any of retention rings 210, 212 and base members 310, for example about 10-40 mm, or about 22 mm. Rods or posts 610 may also have individual or total length substantially greater than the heights of retention rings 210, 212 and base members 310, for example 100-1000 mm, 300-500 mm, about 450 mm, or about 432 mm. Alternatively, the individual and total lengths of connecting rod or post members 610 may vary, depending on the desired size and configuration of tower assembly 100.

Figure 9A:
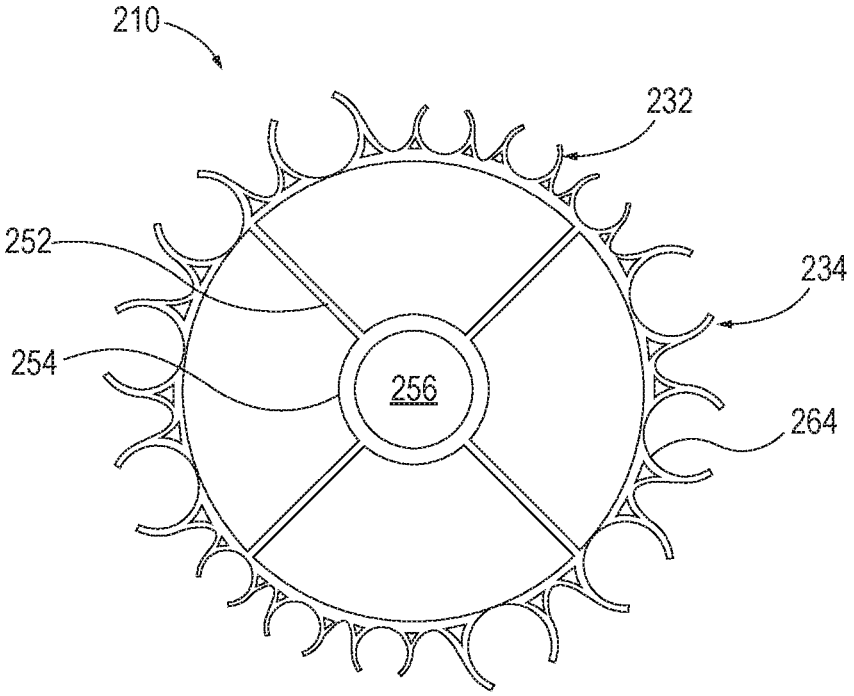
FIG. 9A is a bottom view of a retention ring for the brush drying and storage apparatus.

FIG. 9A is a bottom view of an exemplary brush retention frame or ring 210, for example as suitable for any of retention rings or frame members 210 or 212. As shown in FIG. 9A, retention ring 210 is generally annular or cylindrical, but retention ring 210 may take other forms. For example, retention ring 210 may be polygonal, oblong, oval, or have another shape.

In this particular example, retention ring 210 includes a plurality of brush handle retainers 232, 234, of various sizes, disposed about the outer circumference of ring 210. A plurality of ribs or other structural members 252 connect inner wall 254 at bore 256 to outer wall (or ring wall) 264. Bore 256 is defined within inner wall 254 of retention ring 210, for example axially in the general center, and is configured for connecting retention ring 210 to a suitable post member 610 or other support frame element, as described herein. As shown in FIG. 9A, various brush clips or other retainers 232, 234 are disposed along the circumference of brush retention ring 210, extending radially outward from the periphery of ring wall 264.

Inner wall 254 defines bore 256, forming an (e.g., axial) opening extending into or through retention ring 210. The size, shape and location of inner wall 254 may vary, and portions of inner wall 254 and bore 256 may extend entirely or partially through ring 210. Inner wall 254 can also define bore 256 with a shape configured to receive the end of a particular connecting rod or post 610, for example with a complementary round, square, oblong, polygonal, or specially shaped (e.g., I, H, or X-shaped) post and bore configuration.

Inner wall (or ring bore wall) 254 can also provide one or more retention features or mechanisms in order to discourage movement of retention ring 210 along support post 610, when post 610 is inserted into bore 256. For example, ring bore wall 254 and post 610 may have a complimentary ball and detent structure, locking spring fingers, locking arms, set screws, threading, adhesives, fasteners, or other coupling and retention features, or a friction fit can be used. The material of the post and inner wall 254 can also be selected for coupling and retention properties, for example using rubber, latex, silicone, or other materials that encourage friction, stiction, or other stationary coupling action.

Retention ring 210 may also have one or more support ribs or other reinforcing members 252 extending from, attached to, or integrated with inner wall 254 and/or outer wall 264. For example, reinforcements 252 may be formed as support ribs, with a thickness of 1-10 mm (e.g., about 2 mm) and a radial length of 10-50 mm (e.g., about 30 mm), as defined between inner wall 254 and outer ring wall 264. Other reinforcements 252 may take various configurations, including thicker, thinner, longer, shorter, straight, and curved examples.

Brush retainers 232, 234 may be integrally formed into retention ring 210, or formed separately and attached to retention ring 210. Brush retainers 232, 234 may also be formed separately from one other, or integrally formed in sets. Individual retainers 232, 234 may have different brush retaining features and characteristics, for example similar to those of a clip-type retainer 230, as described herein.

Figure 9B:
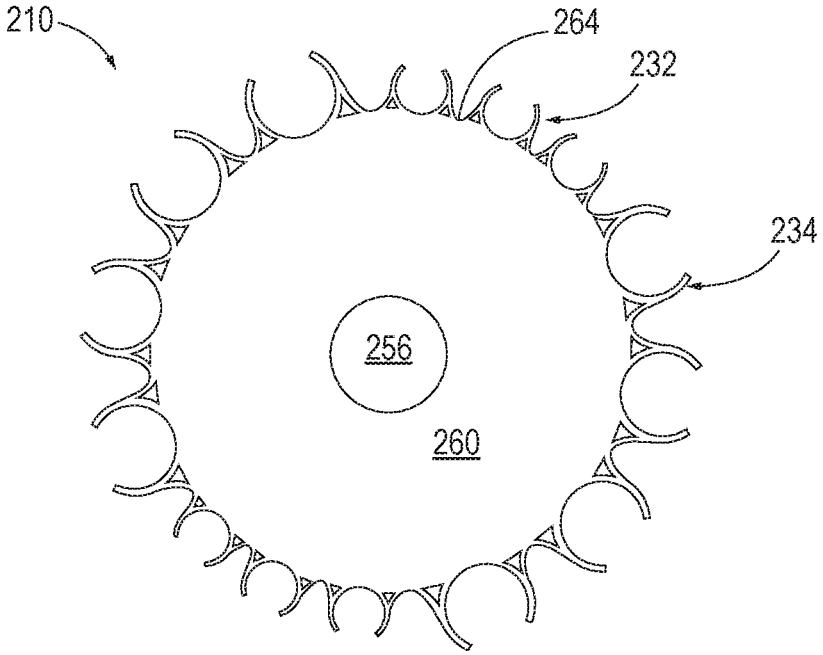
FIG. 9B is a top view of the retention ring.

FIG. 9B is a top view of retention ring 210. In this view, the top surface of retention ring (or retainer) body 260 can be seen, as well as central bore 256 and various brush retainers 232, 234, distributed about the periphery of outer wall 264.

In some embodiments, body 260 is manufactured integrally with selected brush retainers 232, 234 in order to form a substantially unitary retention ring 210. Alternatively, body 260 may be formed with one or more features including inner wall 254 and reinforcements 252, where selected brush retainers 232, 234 are attached to the circumference of outer wall 264. Body 260 may also be substantially uniform and match the shape of retention ring 210, or body 260 may define a different shape with various additional openings and other features.

Figure 10A:
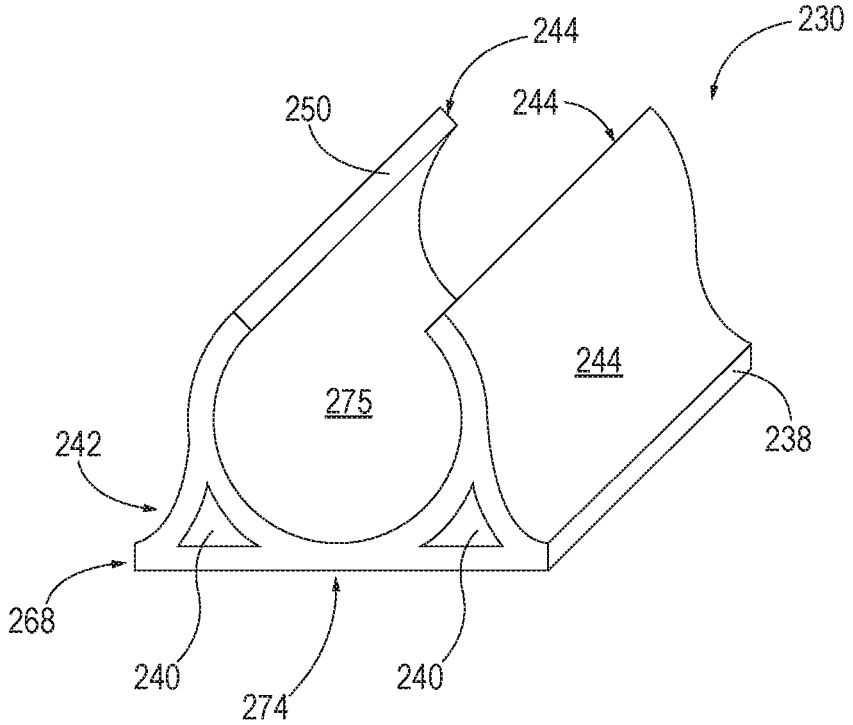
FIG. 10A is an isometric view of a brush retainer for the retention ring.

FIG. 10A is an isometric view of a clip-type brush retainer 230. Clip retainer 230 is configured to hold a brush handle, ferrule, or other object in a particular position, for example, handle 34 of a cosmetic brush 33, as described herein. As such, retainer 230 may include various retention features including, but not limited to, clips, clamps, spring fingers, grabbers, graspers, adhesives, loop-and-hook elements, and magnetic coupling elements.

In one particular embodiment, retainer 230 includes two arms 244 or similar extension features coupled to retainer base 238 at reinforcing shoulders 242, e.g., with interior channels or cavities 240 for mass reduction. These components may be separate or integrally formed, for example by extrusion of retainer 230. Bottom surface 274 of retainer base 238 is configured for coupling to the retention ring, and opposite longitudinal sides 268 of base are configured to couple with adjacent retainers 230, as selected by the user based on the desired brush sizes and spacing. Selected retainers 230 may also be detachably coupled to one another and/or to the outer circumference of the retention ring with hooks, pins, screws, adhesives, or other mechanical attachments. Alternatively, retainers 230 can be integrally formed, as described above, either in selected sets or as a complete unit forming the outer circumference of the retention ring.

Brush coupling features or arms 244 extend from base 238 of retainer 230 at shoulder transitions 242, which in turn provide reinforcement for retainer 230. Arms 244 and shoulders 242 define retention opening 275, as configured for receiving a brush handle or ferrule. One or more channels 240 may extend partially or completely through retainer 230, configured for increased airflow, design aesthetics, or to provide flexibility for retainer 230 to accommodate a range of brush and handle sizes within extensions 244 and retention opening 275.

Figure 10B:
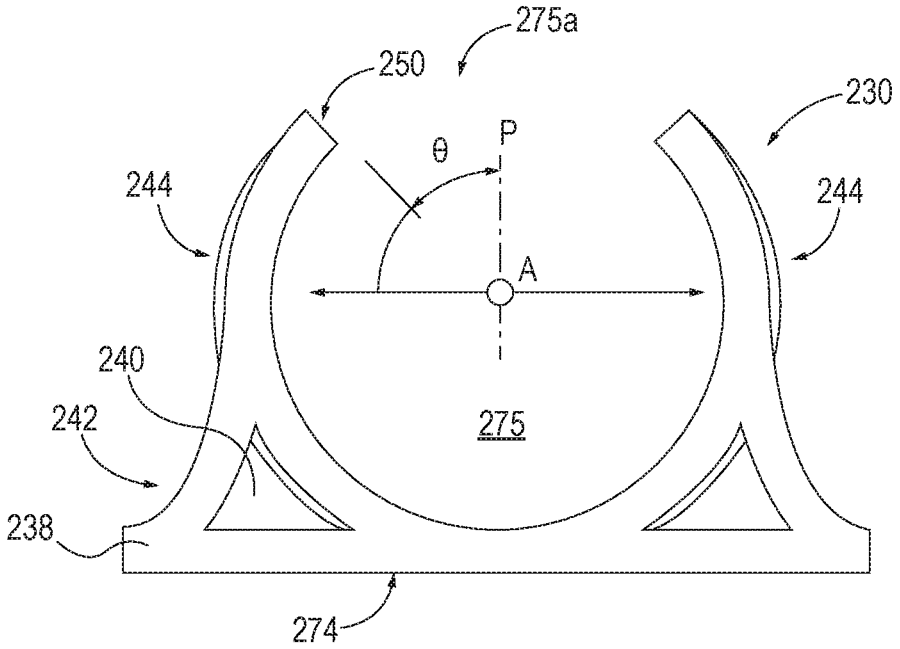
FIG. 10B is a front view of the retainer.

FIG. 10B is a front view of retainer 230. Depending on the configuration, base 238 of retainer 230 may be arcuate, straight, or have a more complex shape, as configured for attachment to the retention ring. As shown in FIG. 10B, channels 240 may take the form of substantially triangular or substantially three-sided openings, or have another shape, as defined within shoulders 242.

In this particular embodiment, extensions 244 define a receptacle 275 having a longitudinal aperture 275A. Receptacle 275 has a substantially circular cross-section corresponding to, or slightly smaller or larger than, the cross section of the corresponding brush handle. The half-opening angle θ (theta) of aperture 275A is defined between end surface 250 of each extension 244 and perpendicular P, which extends perpendicularly through axis A to the bottom surface of receptacle 275, bisecting receptacle 275 midway between extensions 244 and shoulders 240.

As shown in FIG. 10B, the end surfaces 250 of each extension arm 244 are cut or formed at an angle, oriented so that end surface or end wall 250 is substantially parallel to a ray or radius extending from the center axis A of receptacle 275, at the half-opening angle θ. This configuration may aid in the insertion the brush handle into aperture 275A by pushing handle 34 against arm end walls 250 until arms 244 bend apart, allowing the handle to enter receptacle 275.

As half-opening angle θ increases, aperture 275A opens and it becomes easier to insert a brush handle (or other object) into receptacle 275. At the same time, the height of extensions 244 decreases, as does the corresponding retention force exerted by retainer 230 on the brush. As half-opening angle θ decreases, on the other hand, the height of extensions 244 increases and aperture 275A closes, so the retaining force tends to increase but it also becomes more difficult to insert the brush handle. Thus, half-opening angle θ may become a critical factor in defining a suitable retainer 230, relatively independent of brush size and given the elasticity of the material used in extension 244. In some embodiments, for example, suitable half-opening angles θ have a range of about 30° to about 60°, or about 40° to about 50°. In particular embodiments, a suitable half-opening angle θ is about 45°, for example 45±1°, or 45±2°, or 45±5°.

Figure 10C:
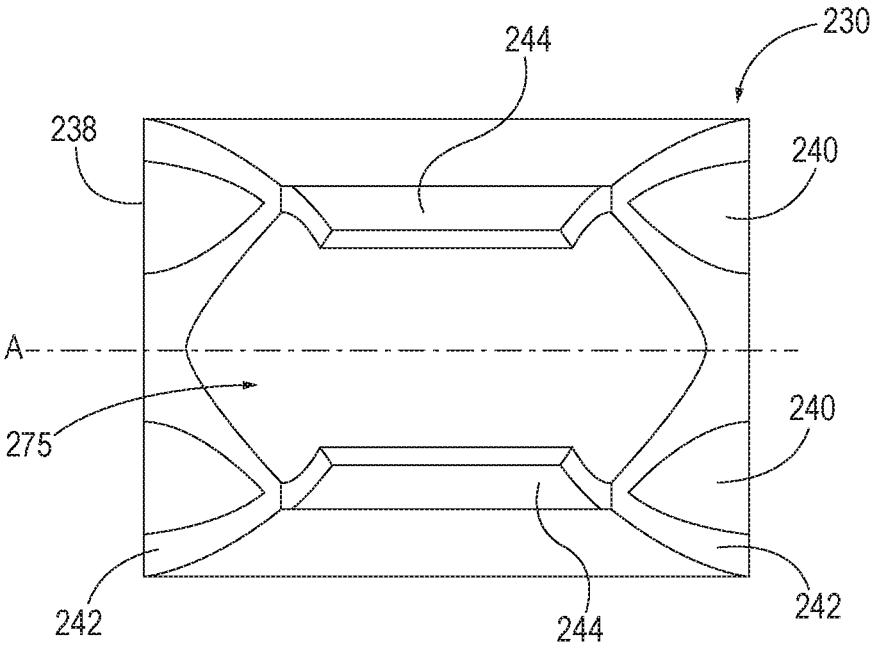
FIG. 10C is a top view of the retainer.

FIG. 10C is a top view of retainer 230. In this example, the axial length of retainer base 238 along axis A of receptacle 275 is about 10-30 mm, for example about 12 mm. The transverse width of base 238 is somewhat less, as defined across axis A, for example in the range of about 5-20 mm, or about 8-10 mm. Extension arms 244 can also be tapered as they extend out from base 12, with a length of about 1-5 mm less at the top than at the base, for example about 3.5 mm less.

Figure 10D:
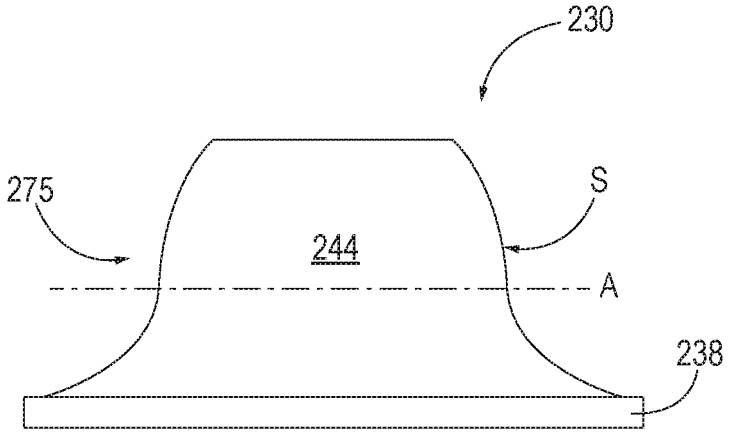
FIG. 10D is a side view of the retainer.

FIG. 10D is a side view of retainer 230. As shown in FIG. 10D, extension arms 244 may decrease in axial length as they extend up from base 238, for examine in the above range. The rate of the taper may also be constant or it may vary, in order to improve coupling to the brush, for example producing an S-shaped curve edge at the ends of each extension 244 as shown.

Figure 11A:
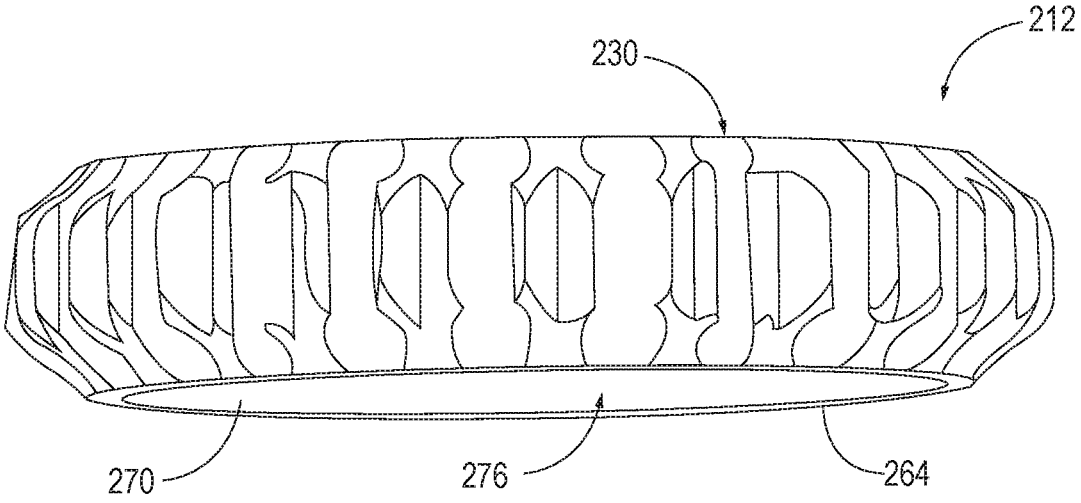
FIG. 11A is an isometric view of an alternate retention ring for the brush drying and storage apparatus.

FIG. 11A is an isometric view of retention ring 212. In this embodiment, individual brush retainers 230 are integrally connected along outer wall 264 to form a ring-shaped retention member 212, with retainers 230 distributed about major opening 276 of retention ring 212.

The size and shape of major opening 276 may vary. In one example, outer wall 264 may define opening 276 similarly to a bore, with a circular opening 276 configured receive the cylindrical end of a connection rod or post. In one such example, opening 276 has a diameter of 10-50 mm, for example about 22 mm, depending on the closeness of desired fit and selected retention mechanism. Alternatively, opening 276 may define a complementary circular, oval, polygonal, oblong, or other specially-shaped geometry for receiving the post, as described above.

Figure 11B:
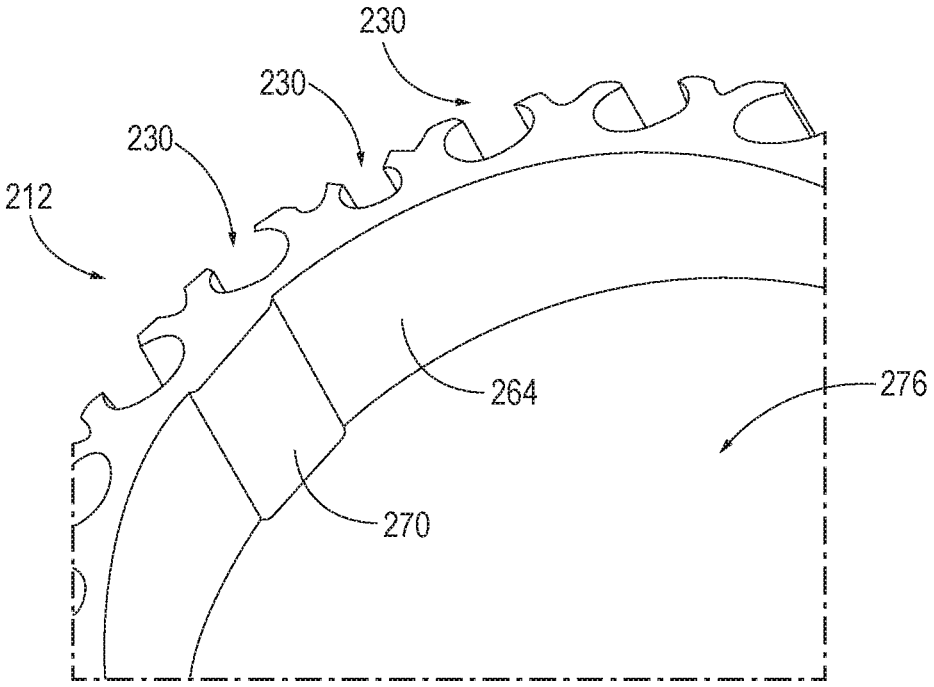
FIG. 11B is detail view of the alternate retention ring.

FIG. 11B is a detail view of retention ring 212 shown in FIG. 11A. This view shows the interior-facing surface of outer wall 264 and ring attachment 270, in the form of a ridge, slot or other mechanism formed in outer wall 264 and configured for connecting retention ring 212 to a support post or other object. In other embodiments, attachment 270 may be used to secure retention ring 212 to base member. Attachment 270 may also take other forms, for example a ball or detent structure, a locking spring or arm, a set screw, a threaded or adhesive coupling, a hook-and-loop fastener, or a friction fitting.

In some embodiments, retention ring 212 may be configured to fit around a base member, with the entire disc-and-ring structure installed on a connecting rod or post. This may be accomplished, for example, by positioning retention ring 212 around base member 310 and rotating retention ring 212 to engage attachment point 270 with a corresponding slot or opening in the base member, or on the post itself as described above.

Figure 11C:
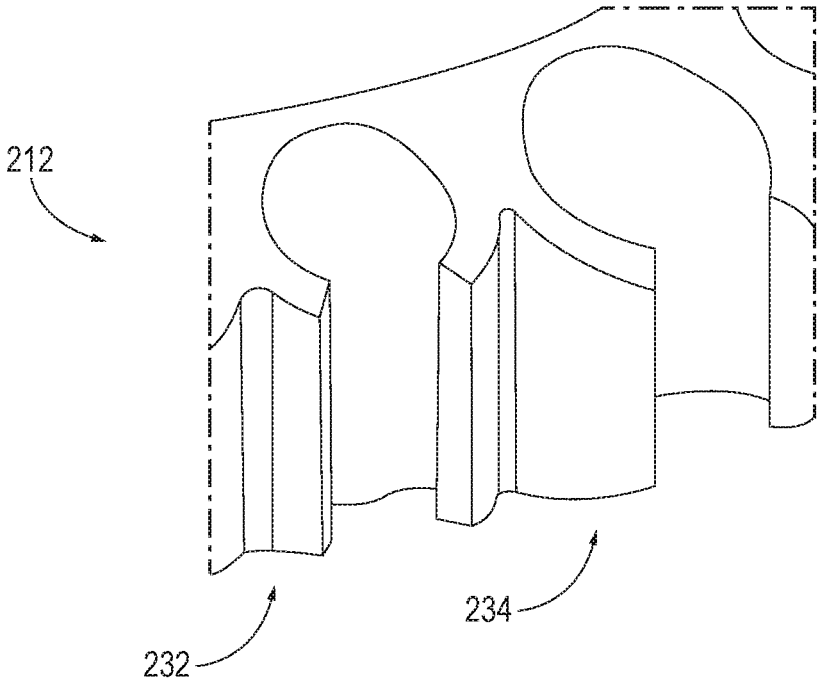
FIG. 11C is a detail view illustrating different retainer sizes.

FIG. 11C is a detail view of retention ring 212, showing adjacent brush retainer clips 232 and 234 with different sizes. In this particular embodiment, retainer 232 is of relatively smaller size than retainer 234, and retainer 234 is of a relatively larger size than retainer 232.

Figure 11D:
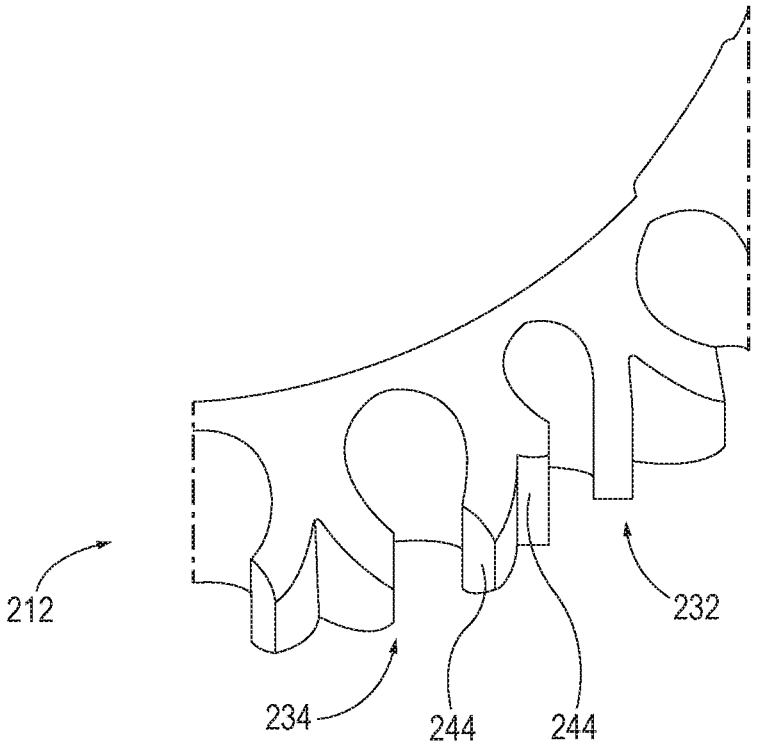
FIG. 11D is a detail view showing a plurality of retainers with different sizes.

FIG. 11D is detail view showing a plurality of clip retainers 232, 234 with different sizes. In this view, it can be seen that extensions 244 of the relatively smaller retainer 232 do not extend out as far out as extensions 244 of the relatively larger retainer 234.

Figure 12A:
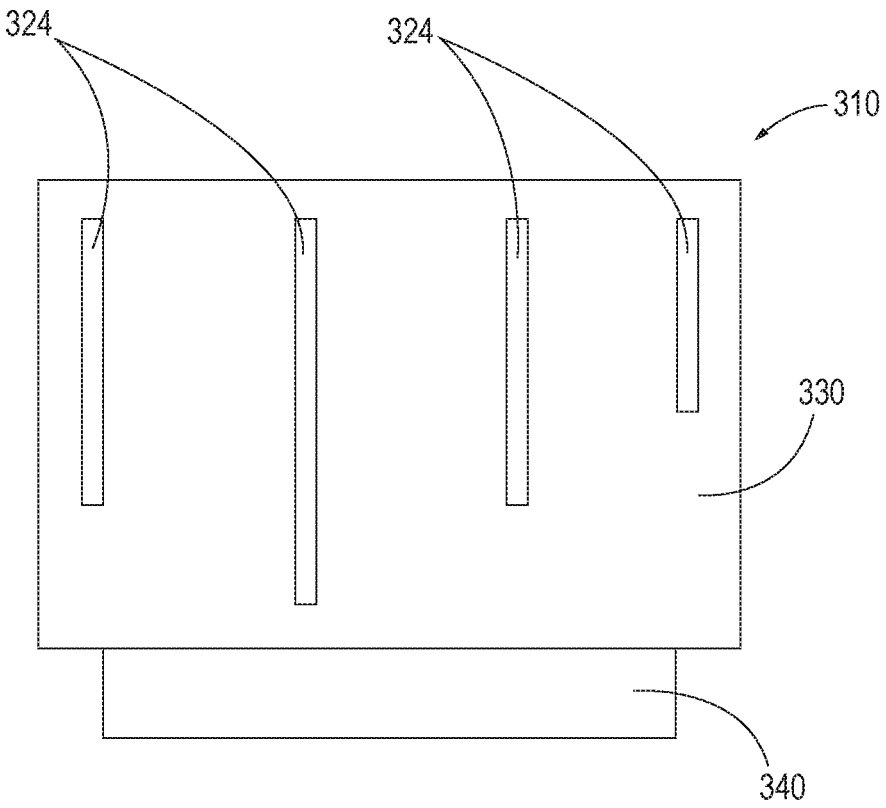
FIG. 12A is a side view of a base or sleeve retention member for the brush drying apparatus of FIG. 8.

FIG. 12A is a side view of a base member or disc 310 for the brush drying apparatus, with outer wall 330 and lower base portion 340. Openings 324 are defined in outer wall 330 of base member 310, above lower base portion 340. Opening 324 can be configured to attach elastic sleeves or tubular drying devices to base member 310, as described herein.

Figure 12B:
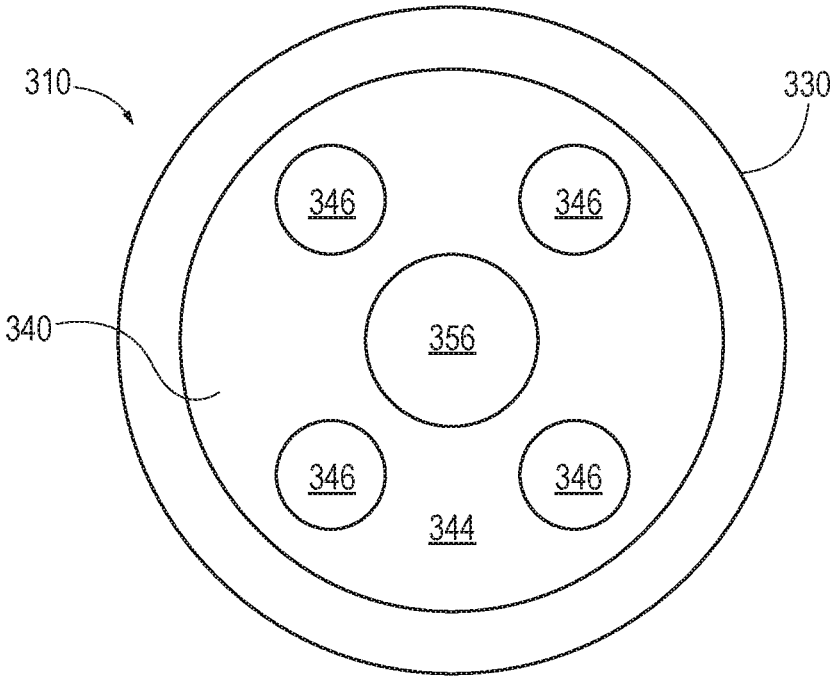
FIG. 12B is a bottom view of the base or sleeve retention member.

FIG. 12B is a bottom view of base member 310, with feet 346 disposed on bottom surface 344 of lower base portion 340, about a centrally positioned bore 356. Feet 346 may include various structures for improving the stability of base member 310, for example suction cups, adhesive strips, fasteners, or rubber or felt pads.

Figure 12C:
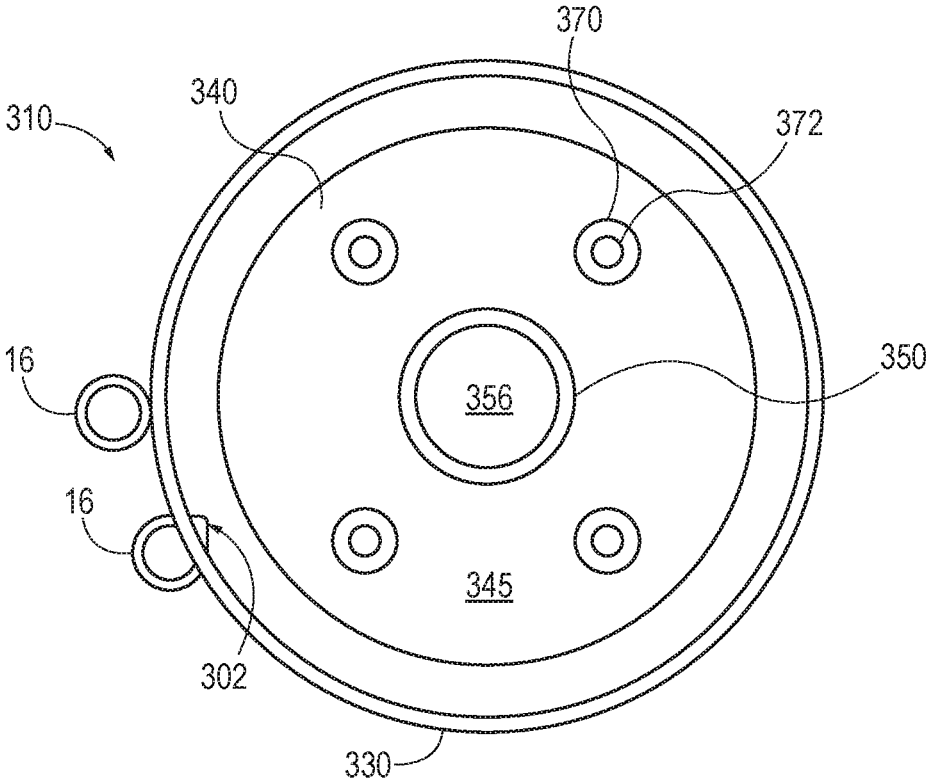
FIG. 12C is a top view of the base or sleeve retention member.

FIG. 12C is a top view of base member 310, including a plurality of internal posts 370 and a hub 350 defined about a central bore 356, extending through top surface 345 of lower base portion 340. Outer wall 330 defines the outer circumference of base member 310. Hub 350 defines bore 356 for a connecting rod or post, as described above. Internal posts 370 provide alignment or attachment features to facilitate attachment of a cover, for example using a extension pin 518 inserted into post bore or post hole 372 for coupling to cover 510, as described herein.

As shown in FIG. 12C, various drying sleeves or tubular devices 16 may be attached to outer wall 330 of base member 310. This connection may also be accomplished by complimentary mechanical fastening features presented on one or both of sleeve 16 and outer wall 330, for example in a releasable (detachable) configuration, or in a substantially permanent (fixed) configuration.

In one example, a portion of sleeve 16 is inserted through an opening or aperture 324 in outer wall 330, and a pin, clip or stop 302 is attached to sleeve 16 within outer wall 330, in order to prevent sleeve 16 from being pulled back out or detached. The stop or other mechanical fastener 302 can also be configured for removal from sleeve 16, and to release sleeve 16 from base member 310. Alternatively, a screw, hook or other detachable coupling arrangement can be used, or an adhesive or other permanent attachment.

Figure 13:
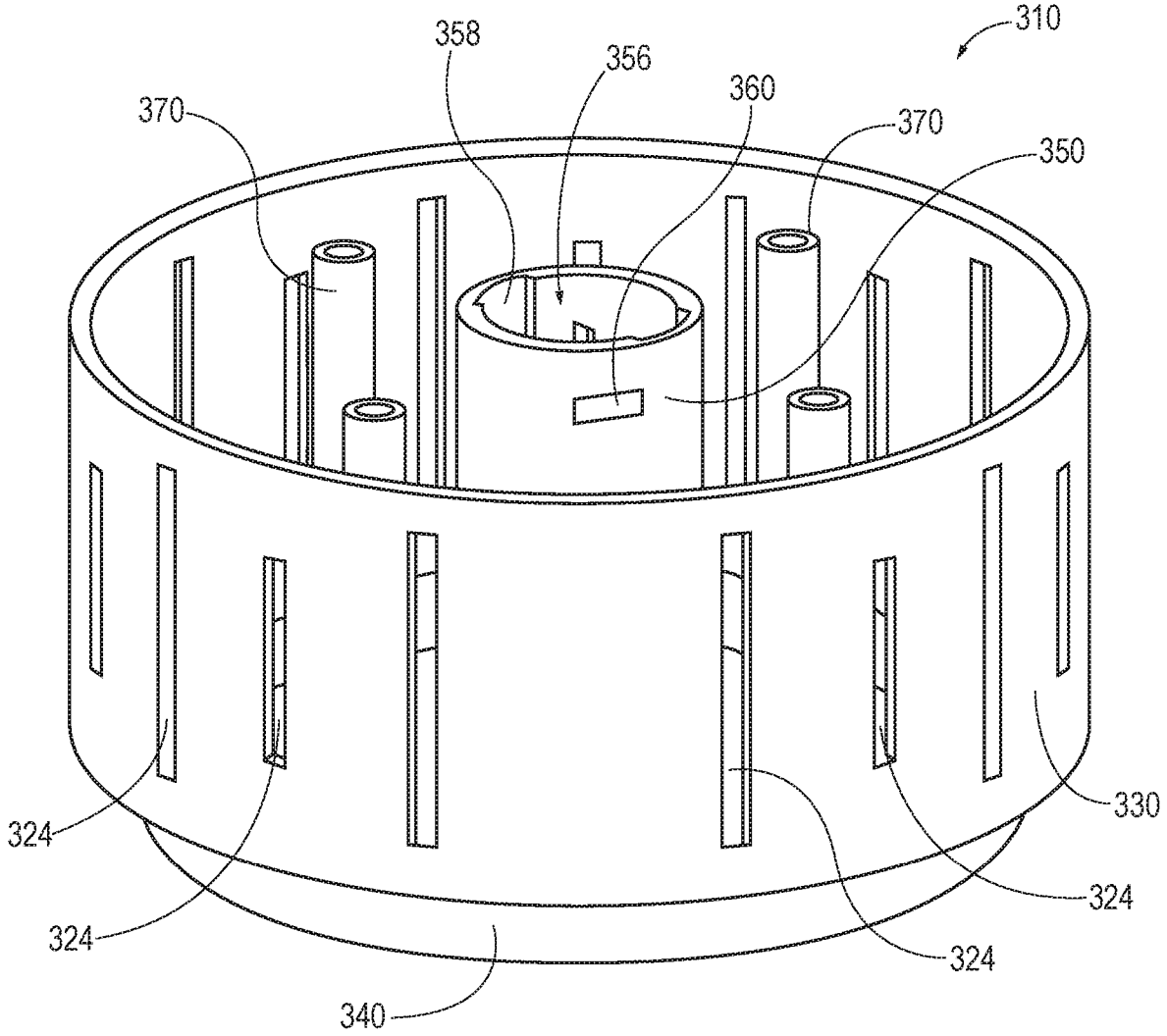
FIG. 13 is a perspective view of the base or sleeve retention member.

FIG. 13 is an isometric view of base member 310, including hub 350, internal posts 370, outer wall 330 and lower base portion 340. Outer wall 330 defines a plurality of openings or apertures 324, which are configured with various shapes and sizes to accommodate a range of sleeves 16. For example, openings 324 may be square, rectangular, elongate, thin, thick, large, small, narrow, long, or rounded.

The inner wall of hub 350 defines a central bore 356. In some embodiments, hub 350 may also include coupling features for a connecting post or rod to bore 356, for example a notch 358 sized and shaped to engage with a corresponding post attachment feature. Detent 360 may also be provided, for example as an opening in hub 350 configured to engage a similar feature on the support post, and thus to resist or arrest movement the post and lock it to the base member 310 within bore 356. Hub 350 may also include similar features for attaching or retaining a cover element, for example in cooperation with internal posts 370 as described herein.

Figure 14A:
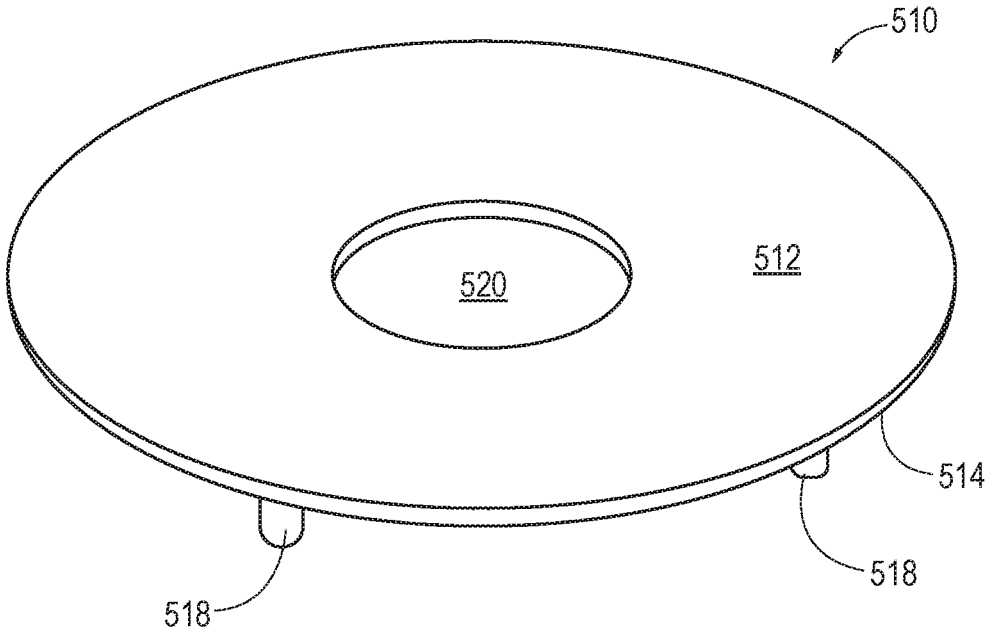
FIG. 14A is an isometric view of a cover for the base or sleeve retention member.

FIG. 14A is an isometric view of an exemplary cover 510 for base member 310, with extension pins 518 extending opposite the upper or top surface 512 of cover body 514. Cover bore 520 extends through cover body 514 in the central region of cover 510, and may be sized and shaped to accommodate a coupling rod or post.

Cover 510 may take various shapes, for instance circular, square, rectangular, or another shape, complementary to the particular geometry of a selected base member 310. Connection between cover 510 and the base can be facilitated by extensions 518, which are configured to align with and insert into internal posts 370. Alternatively, cover 510 may be similarly configured to couple with a retention ring 210 or 212.

Figure 14B:
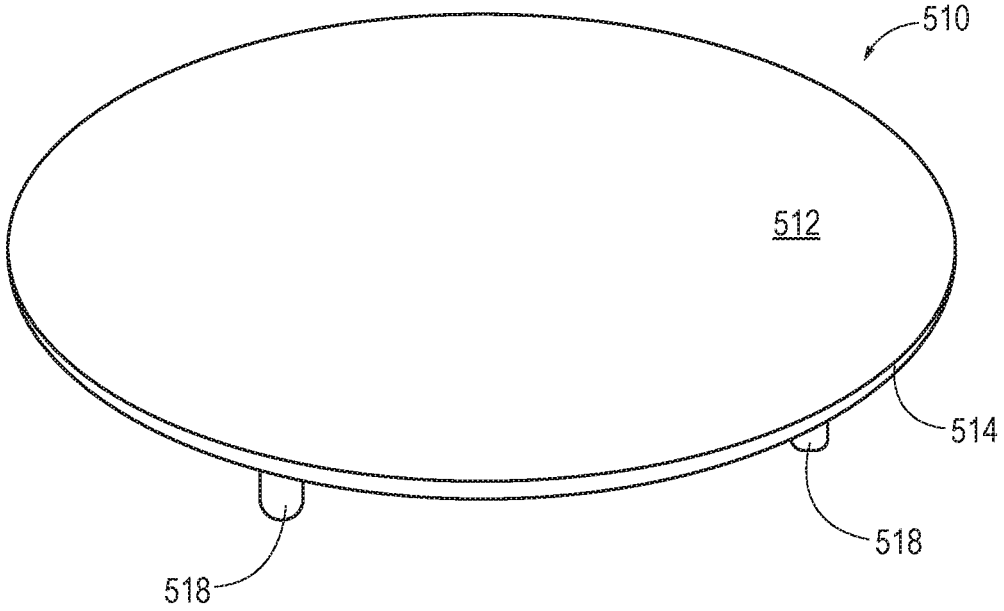
FIG. 14B is an isometric view of the cover, in an embodiment without a central bore.

FIG. 14B is an isometric view of cover 510, in an embodiment without cover bore 520. This configuration may be useful when cover 510 attaches to a top retention ring or other frame element positioned upper-most in the tower apparatus 100, where the connecting post or rod does not extend through cover 510.

Figure 15A:
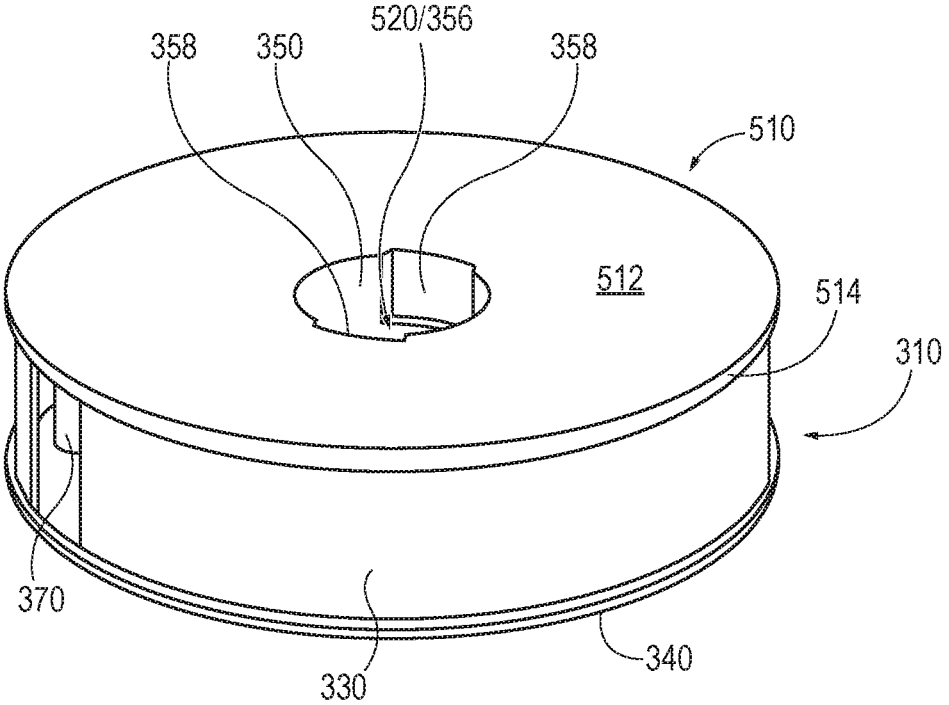
FIG. 15A is an isometric view of the cover installed on the base or sleeve retention member.

FIG. 15A is a perspective view of cover 510, coupled to base member 310. In this embodiment, cover bore 520 is shaped to match central bore 356, as defined by hub 350 of base member 310. Lower base portion 340 and cover 510 each have slightly larger diameter than outer wall 330 of base member 310. Notches 358 are provided within hub 350, in order to couple with complementary retention features on the connecting rod or post.

Figure 15B:
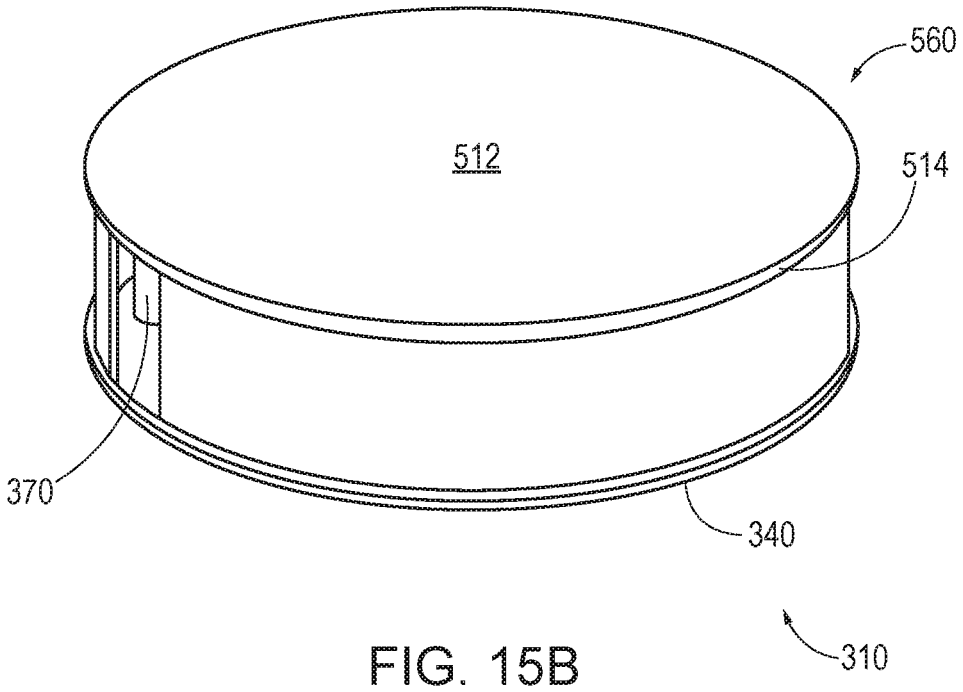
FIG. 15B is an isometric view of the cover installed on the base or sleeve retention member, without the central bore.

FIG. 15B is a perspective view of an alternate cover 510 on base member 310. In this embodiment, there is no cover bore 520, and the top of base member 310 is entirely covered by cover body 514.

Figure 16:
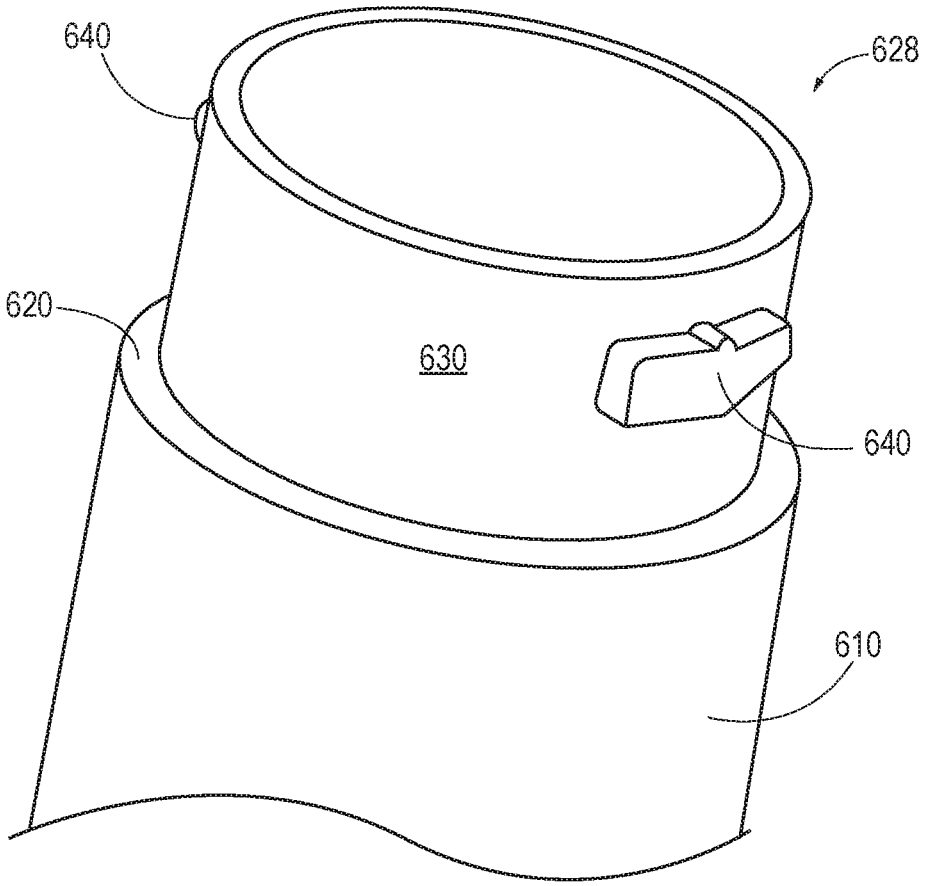
FIG. 16 is an isometric view of a connecting rod or post for the brush drying and storage apparatus.

FIG. 16 is an isometric view of a connecting rod or post 610 with attachment 628 defined on one or more ends of post 610. Attachment 628 encompasses features configured to aid in or accomplish retention, connection, or attachment between post 610 and one or more of a base member, cover or retention ring, as described herein. Similar attachment features or portions 628 may also be located at various locations along the length of rod 610, for example in between the two ends.

In this particular example, attachment 628 includes a shoulder feature or chamfer 620 and one or more keys or pins 640. Chamfer 620 defines the transition between connecting post 610 and attachment 628. The transition may include a gradual or abrupt increase or decrease in diameter, or another transition such as a threaded or surface texture transition. As shown in FIG. 16, keys 640 are formed as radial extensions from connecting post 610, extending circumferentially and longitudinally along outer wall 630 of attachment portion 628, and configured to engage complementary structures in the base member, retention ring, or cover bore.

Figure 17:
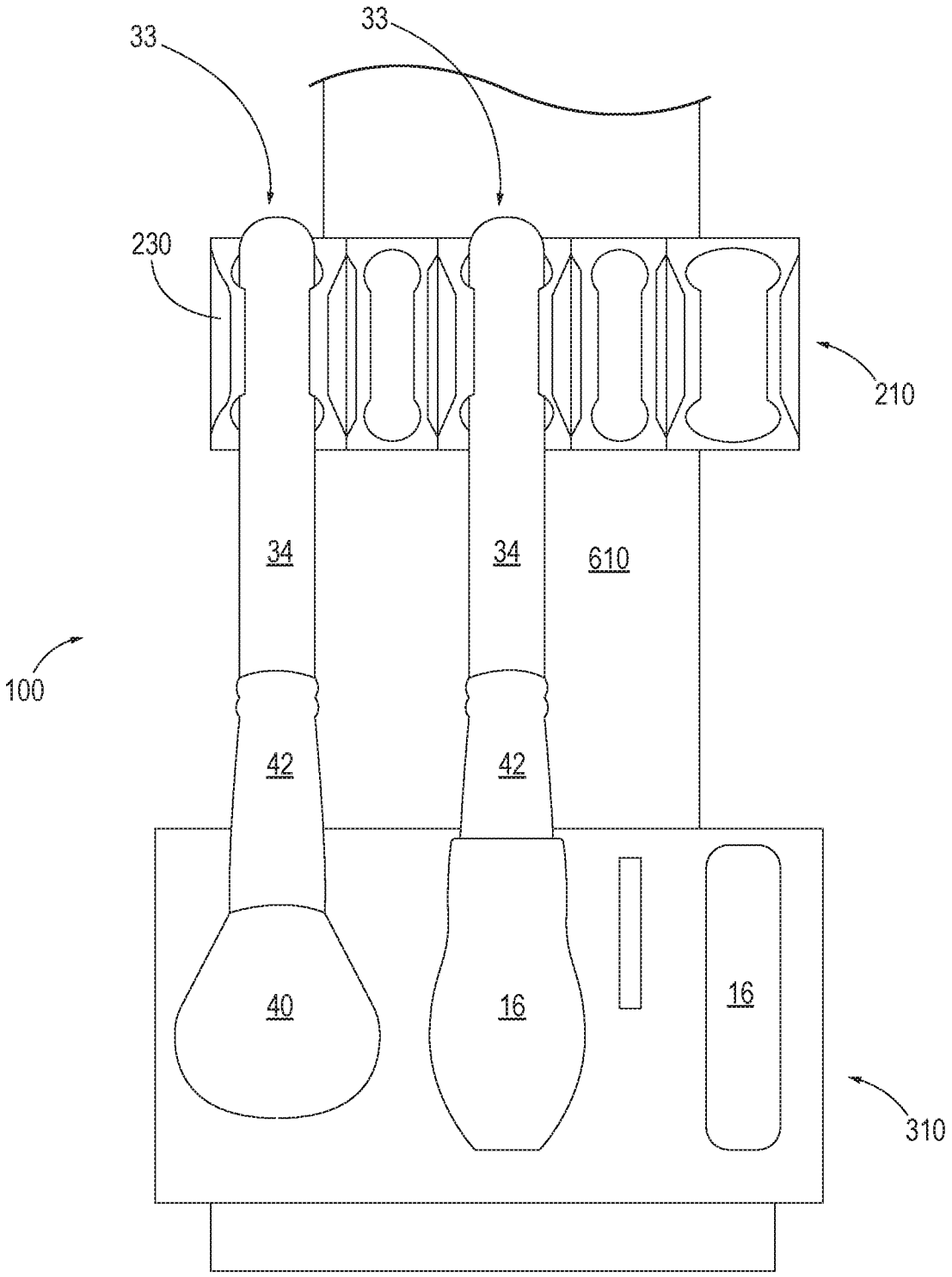
FIG. 17 is a side view of the brush drying and storage apparatus, with a plurality of brushes.

FIG. 17 is side view of brush drying and storage tower apparatus 100, with brushes 33. In this example, brushes 33 are retained in a downward direction by retainer clips 230, positioned to retain handles 34 of brushes 33 in retention ring 210. Sleeve 16 is installed over the bristles of the right-hand brush 33, and a portion of ferrule 42, in order to facilitate drying and shaping of the bristle bundle. The left-hand brush 33 is suspended with bristle bundle 40 exposed, for example before inserting bundle 40 into a sleeve 16, or after drying and shaping is complete.

Generally, apparatus 100 may be constructed with one or more brush-retention portions 210 vertically spaced from one or more sleeve-retention portions 310 via a rod or post 610. The brush-retention portions may include, for example, a modular retention ring 210 or 212, with one or more retainers 230 or other features configured to hold brushes 33 in place. The sleeve-retention portions may include a modular base member 310 or other structure configured to hold one or more sleeves 16, or other tubular bristle drying and shaping devices 16.

Assembly and Use

Exemplary embodiments of apparatus 100 may be custom assembled from and disassembled into a collection of modular parts. This process may include placing a base 310 on a surface. The base 310 may be specially suited for being a base for a tower structure (e.g., having specialized feet, weights, or other features), or it may be a generic disc member.

One or more tubular brush drying and shaping devices or sleeves 16 may be attached or installed on base member 310 (for example, around its circumference). This process may involve feeding a portion of each selected sleeve 16 through an opening 324 in the outer wall 330 of the base member, and attaching a stop or other mechanical fastener 302. Selected sleeves 16 may also be attached to base 310 utilizing mechanical fastening features provided between each sleeve 16 and base 310, without feeding a portion through any opening 324.

Cover 510 may be attached to base 310. If the user desires to add additional modular members or features to apparatus 100, cover 510 may have a cover bore 520 to allow for the insertion of a connecting post 610. Alternatively, cover 510 may be provided without a cover bore 520. In one embodiment, cover 510 is be added to base 310 by aligning and inserting one or more extension pins 518 into one or more post bores 372 in internal posts 370 of base 310, as described herein. In other embodiments, cover 510 may be locked onto or otherwise fastened to base 310.

If additional modular elements of apparatus 100 are desired, a post 610 may be inserted into a hub or central bore 356 of base 310. If base 310 has a cover 510 with cover bore 520 installed, then a portion of post 610 may pass through cover bore 520 as well. In embodiments of base 310 where both base 310 and post 610 have locking or other attachment features, additional steps may be necessary to attach base 310 and post 610. In one such embodiment, these steps may include mating an attachment portion 628 of post 610 with a hub notch 358 or similar feature defined within hub 350, for example by inserting post 610 into hub 350 and rotating attachment portion 628 until a pin or key 640 on post 610 engages with a complimentary detent 360 or other locking feature 270 in hub 350. Other embodiments may include ensuring a friction fit between post 610 and base 310, for example with a friction surface between the outer surface or wall 630 of the attachment portion 628 of the post 610, and the inner wall of hub 350, and/or using a threaded connection or mechanical fastener such as a screw.

One or more retention rings 210 may also be added to apparatus 100. For example, if a retention ring 210 has a bore 256 sized to a substantially close fit with a connecting post 610, the retention ring 210 can be inserted onto the post 610 such that the post 610 passes through the ring bore 256. Depending on the attachment features present on retention ring 210 and rod or post 610, various methods of setting the location of ring 210 on post 610 may be utilized, including similar methods to those described above for attaching base 310.

As another example, one or more retention rings 210 or 212 may have an opening 276 sized to fit around a base 310. This form of retention ring 210 or 212 can be installed on apparatus 100 by, for example, positioning the retention ring 210 around base 310 and rotating until an attachment feature 270 or 360 engages with a complementary feature of base 310 (for example, an opening 324 in a wall of base 310). After retention ring 210 or 212 is installed on base 310, the ring-and-disc members can be installed on a post 610 through similar methods.

One or more retainers 230 may also be attached to retention ring 210. This step can be accomplished by attaching a retainer 230 to retention ring 210 via complimentary mechanical coupling features on the retainer base surface 274 and outer wall 264 of the retention ring, and/or outer wall 330 of a base member 310.

Through the above combination of assembling steps, apparatus 100 may be constructed and used to dry and/or store brushes. These latter steps can be accomplished by, for example, inserting a brush into a retainer (e.g., a retainer 310 located on a retention ring 210). This step may be performed such that the brush bristles are facing in a downward direction (e.g. towards the base of the tower), but other hanging configurations are possible, for example with the bristles facing up.

In order to speed drying or preferentially shape the bristles of the brush, an elastic sleeve 16 may be positioned over the bristle bundle, for example in a surrounding and compressive, conforming relationship. Sleeve 16 can be configured to eliminate water from the bristles by radially compressing them and removing the water by compression, capillary action and/or evaporation through the expanded sleeve 16.

Selected sleeves or tubular drying devices 16 may also be provided as a discrete part that is installed over the brush prior to coupling the brush onto the tower apparatus. In other embodiments, selected sleeves 16 can be provided as a component of the tower apparatus.

Sleeves 16, retainers 310 and the length of the different brushes can be selected such that a portion of the brush handle is held by the retainer 310, and the bristles of the brush hang down substantially near a selected sleeve 16 configured to be installed around the bristles. It may also be possible to forgo hanging the handle of the brush onto the retainer 310, and instead use the sleeve 16 as the primary or only structure holding the brush onto or retaining the brush within the tower. The above steps can also be used to hang one or more brushes on the tower in order to store, hold, and/or dry the one or more brushes in a relatively compact space.

Examples

Devices and systems for rapidly drying and shaping fine-bristled brushes include a resilient, water permeable tubular band or sleeve, designed to surround a bundle of bristles when in a radially expanded state. An elastic restoring force exerted by the sleeve acts radially inwardly against the bundle, compacting the bristles against one another. The compaction tends to preserve or restore a desired shape of the bundle, and substantially closes interstitial regions or open spaces ordinarily present between and among the bristles. Substantial closure of the interstitial regions, along with the use of a breathable material in the fibers used to construct the sleeve, contributes to a surprising and considerable reduction in bristle drying time.

A system suitable for simultaneously drying several brushes includes a base structure supporting a plurality of the sleeves, each sleeve aligned with a receptacle for the brush handle provided in a retention structure coupled to the base structure via a support rod or post to form a tower. The tower structure can be provided in modular form, utilizing one or more selectively interchangeable base, retention, and support post elements, each provided with or without a cover element.

An apparatus for drying a plurality of brushes is provided, each having a handle and a bundle of bristles extending from the handle. The apparatus comprises a base member, a brush retention member, and a support member. The base member supports a plurality of elastic sleeves configured for stretching about and conforming to the bundles of bristles in a radially compressive relationship. The brush retention member have a plurality of brush retainers configured for retaining the handles of the respective brushes, and the support member is configured for releasably locking or connecting to the base member and the brush retention member, in a spaced relationship along the brush handles. Each brush handle is retained in one of the brush retainers, and each respective bundle of bristles is positioned for engagement with a corresponding one of the elastic sleeves, in the radially compressive relationship.

An apparatus is also provided for drying and shaping bristles of a brush. Each brush comprises a handle elongate in a longitudinal direction, a plurality of bristles, and a ferrule at a distal end of the handle. The ferrule is configured to support the bristles with respect to the handle in a generally longitudinal extension, away from the distal end handle, to form a bundle composed of the plurality of bristles extending generally in a longitudinal direction and interstitial regions between and among the bristles. The apparatus comprises a disc or base member having at least one resilient, moisture permeable tubular band member disposed about a tube axis of the tubular band member. The tubular band member has a nominal tube diameter less than a diameter of the bundle when in a contracted state, and the tubular band member is extensible elastically in a circumferential direction to a radially expanded state, in order to allow placement of the tubular band member in surrounding contiguous relation to accommodate the bundle of the brush, with the tube axis extending substantially in the longitudinal direction.

A brush-retention member is provided with at least one clip or retainer capable of holding the handle of the brush. A rod is connected to and vertically separates the disc and the brush-retention portion, so that the distance between the brush-retention portion and the base or disc is less than the length of the brush. The tubular band member, when in the surrounding contiguous relation with the bristles, surrounds the bundle with the tube axis oriented substantially in a longitudinal direction along the brush handle. In the radially expanded state, the band member produces an elastic restoring force acting radially inwardly against the bundle to compress adjacent bristles against one another and to substantially close the interstitial regions. The elastic restoring force exceeds a level of radially inward force necessary to establish a frictional engagement of the tubular member and the bundle by more than an order of magnitude.

A device for drying and shaping bristles of a brush includes a resilient, moisture permeable tubular member disposed about a tube axis and having a nominal tube diameter in a contracted state, the tubular member being elastically extensile in a circumferential direction to allow placement of the tubular member in surrounding contiguous relation to a bundle of a brush, the bundle being composed of a plurality of the bristles extending generally in a longitudinal direction and interstitial regions between and among the bristles, with the tube axis extending substantially in the longitudinal direction. A disc or base is provided with one or more of the resilient, moisture permeable tubular members attached thereto. A brush retention portion includes a retainer capable of holding the handle. A rod or post extends through and connects the disc or base and the brush-retention portions of the device. The tubular member is formed of intercalated fibers including resilient fibers extending in the circumferential direction and substantially inextensible fibers extended in the longitudinal direction. The resilient and substantially inextensible fibers cooperate to allow a circumferential elastic expansion of the tubular member while preventing any substantial expansion of the tubular member in the longitudinal direction.

An apparatus is provided for drying a plurality of brushes, each of the brushes having a bundle of bristles extending from an elongate handle. The apparatus comprises a sleeve retention member supporting a plurality of elastic sleeves, each of the elastic sleeves configured for surrounding one of the bundles of bristles in a radially compressive and conforming relationship. A brush retention member supports a plurality of brush retainers, each of the brush retainers configured for retaining the handle of one of the brushes. A post, rod or other support member connects the base member to the brush retention member in a spaced relationship along the brush handles. Each brush handle is retained in one of the plurality of brush retainers, and each respective bundle of bristles is positioned for engagement in the radially compressive and conforming relationship with a corresponding one of the elastic sleeves.

In any of the examples and embodiments herein, the sleeve retention member may comprise a base member and the apparatus may be oriented in a tower configuration with the brush retention member disposed above the base member on the support member. Further, the base member, the support member and the brush retention member may be configured in modular form, for selective assembly and disassembly of different configurations of the tower apparatus.

A second base member may be disposed above (or along the longitudinal direction from) the brush retention member, and a second brush retention member may be disposed above (or along the longitudinal direction from) the second base member. A cover may be disposed on the base member, where the cover includes a central bore through which the support member extends.

In any of the examples and embodiments herein, any or all of the brush retainers may comprise a snap engagement member having a base coupled to the brush retention member and a pair of flexible extensions extending from the base to define a brush receptacle for retaining the handle of one of the brushes, and further defining a longitudinal aperture width smaller than a diameter of the brush handle. Each of the brush retainers may have shoulder interfaces with a longitudinal channel extending through an interface between the extensions and the base, where the longitudinal channel is configured with sufficient flexibility for the extensions to accept the diameter of the brush handle within the longitudinal aperture, and to provide sufficient elastic restoring force to retain the brush handle within the brush receptacle. The longitudinal aperture can be defined between the end surfaces of the flexible extensions, with the ends extending parallel to a longitudinal axis of the brush receptacle. The end surfaces of the extension can be defined along radii extending from the axis of the brush receptacle, where the radii define half-opening angles of about 40° to about 50° for the longitudinal aperture.

In any of the examples and embodiments herein, each sleeve may comprise a tubular member formed of intercalated fibers including resilient fibers extending in a circumferential direction and substantially inextensible fibers extending in a longitudinal direction. The resilient and substantially inextensible fibers can cooperate for circumferential elastic expansion of the tubular member in the radially compressive and conforming relationship with the respective bundle of bristles, while preventing substantial expansion of the tubular member in the longitudinal or axial direction.

In any of the examples and embodiments herein, any of all of the brushes may comprise a ferrule configured to support the bundle of bristles in a generally longitudinal extension from the brush handle, with the sleeve retention member configured to dry the brush by compressing adjacent bristles in the bundle to substantially close the interstitial regions therebetween. Each elastic sleeve may also comprise a resilient, moisture permeable tubular band member having a nominal contracted diameter less than that of the respective bundle of bristles. Each tubular band member can thus be elastically extensible along a circumference to a radially expanded state configured to engage a respective bundle of bristles, in the radially compressive and conforming relationship. The tubular band members can be further configured to provide an elastic restoring force acting radially inwardly on each respective bundle, and exceeding a level of radially inward force necessary to establish a frictional engagement of the tubular member and the respective bundle by more than an order of magnitude.

An apparatus for drying and storing brushes includes a brush retention ring, base, and support member. The brush retention ring supports a plurality of brush retainers, each configured for retaining a handle of a brush having a bundle of bristles extending therefrom. The base supports a plurality of elastic sleeves, each configured for compressing the bristles of a respective brush in a radially compressive and conforming relationship. The support member connects the base to the brush retention member in a longitudinally spaced relationship, with each brush handle retained in one of the brush retainers and the bristles engaged in the radially compressive and conforming relationship with a respective one of the elastic sleeves, such that interstitial regions between the bristles are substantially closed to facilitate drying.

In any of the examples and embodiments herein, the support member can be configured for locking engagement with the base and brush retention ring, for selective assembly and disassembly of the apparatus in modular tower form. A second base can be disposed above the brush retention ring in the modular tower, and a second brush retention ring can be disposed above the second base. In addition, a cover can be disposed on one or both each of the base members, and one or both covers can include a central bore through which the support member extends.

In any of the examples and embodiments herein, each of the brush retainers may comprise a pair of flexible extensions defining a brush receptacle with a substantially circular cross section and a longitudinal aperture having a width smaller than a diameter of the brush handle. The flexible extensions may have end surfaces defined along radii extending from a longitudinal axis of the brush receptacle, with the radii defining half-opening angles of 45±2° for the longitudinal aperture.

In any of the examples and embodiments herein, the elastic sleeves may each comprise a tubular member formed of intercalated resilient and substantially inextensible fibers extending in circumferential and longitudinal directions, respectively. The resilient and substantially inextensible fibers cooperate for circumferential elastic expansion of the tubular member in the radially compressive and conforming relationship with the bristles, while preventing substantial expansion of the tubular member in the longitudinal direction.

A method is provided for drying and shaping cosmetic brushes, using any of the apparatus embodiments described herein. The method includes placing a cosmetic brush in a brush retainer, the cosmetic brush having a handle disposed in the retainer and extending longitudinally to a bundle of bristles. An elastic sleeve comprising a resilient, permeable tubular member is disposed in surrounding contiguous relation to the bundle of bristles, with the bristles extending longitudinally from the brush handle and defining interstitial regions therebetween. The tubular member produces an elastic restoring force acting radially inwardly against the bundle, in order to substantially close the interstitial regions between the bristles, and to facilitate drying and shaping thereof. The method may also include releasably coupling a retainer ring comprising a plurality of such brush retainers to a support member and releasably coupling the support member to a base member supporting a plurality of such elastic sleeves. The base member, support member and retainer ring can thus define a modular structure for drying and storing the cosmetic brushes, in a variety of different configurations.

While this invention been described with reference to exemplary embodiments, it will be understood by those of skill in the art that various changes may be made and equivalents may be substituted without departing from the spirit thereof. The teachings of the invention can also be applied to different problems, materials, and situations, without changing its essential scope. The invention is thus not limited to the particular examples described here, but includes all of the embodiments encompassed by the appended claims.

The invention claimed is:

1. An apparatus for drying a plurality of brushes, each of the brushes having a bundle of bristles extending from a handle, the apparatus comprising:

a base frame supporting a plurality of elastic sleeves, each of the elastic sleeves configured for surrounding one of the bundles of bristles in a radially compressive and conforming relationship;

a brush retention ring supporting a plurality of brush retainers disposed about an outer periphery of the brush retention ring, each of the brush retainers configured for retaining the handle of one of the brushes; and a support post connecting the base frame to the brush retention ring in a spaced relationship along the brush handles;

wherein each brush handle is retained in one of the plurality of brush retainers and each respective bundle of bristles is positioned for engagement in the radially compressive and conforming relationship with a corresponding one of the elastic sleeves; and wherein each of the brush retainers comprises a snap engagement having a retainer base coupled to the brush retention ring and a pair of flexible extensions extending upward from the retainer base to define a brush receptacle for retaining the handle of one or the brushes, the brush receptacle having a longitudinal aperture width smaller than a diameter of the brush handle; and wherein each of the brush retainers further comprises a longitudinal channel extending through a shoulder interface defined between each of the extensions and the retainer base, wherein the longitudinal channe; is configured for the flexible extansions to have sufficient flexibility to accept the diameter of the brush handle within the longitudinal aperture, and to provide sufficient elastic restoring force to retain the brush handle within the brush receptacle.

2. The apparatus of claim 1, wherein the apparatus is oriented in a tower configuration with the brush retention ring positioned above the base frame on the support post.

3. The apparatus of claim 2, wherein the base frame, the support post and the brush retention ring are provided in modular form for selective assembly and disassembly of the tower configuration.

4. The apparatus of claim 3, further comprising a second said base frame disposed above the brush retention ring in the tower configuration, and a second said brush retention ring disposed above the second said base frame.

5. The apparatus of claim 3, further comprising a cover disposed on the base frame, wherein the cover includes a central bore through which the support post extends.

6. The apparatus of claim 1, wherein each brush comprises a ferrule configured to support the bundle of bristles in a generally longitudinal extension from the brush handle, and wherein the elastic sleeves are configured to dry the brushes by compressing adjacent bristles in each bundle to substantially close interstitial regions therebetween.

7. The apparatus of claim 1, wherein each elastic sleeve comprises a tubular band formed of intercalated fibers including resilient fibers extending in a circumferential direction and substantially inextensible fibers extending in a longitudinal direction, the resilient and substantially inextensible fibers cooperating for circumferential elastic expansion of the tubular band in the radially compressive and conforming relationship with the respective bundle of bristles, while preventing substantial expansion of the tubular band in the longitudinal direction.

8. The apparatus of claim 7, wherein the longitudinal aperture is defined between end surfaces of the flexible extensions, the end surfaces extending parallel to a longitudinal axis of the brush receptacle and defined along radii extending from the longitudinal axis, the radii defining half-opening angles of about 40° to about 50° for the longitudinal aperture.

9. The apparatus of claim 1, wherein each elastic sleeve comprises a resilient, moisture permeable tubular member having a nominal contracted diameter less than that of the respective bundle of bristles;

wherein each tubular member is elastically extensible along a circumference thereof to a radially expanded state configured to engage a respective bundle of the bristles in the radially compressive and conforming relationship; and wherein each tubular member is configured to provide an elastic restoring force acting radially inwardly on the respective bundle and exceeding a level of radially inward force necessary to establish a frictional engagement of the tubular member and the respective bundle by more than an order of magnitude.

10. An apparatus for drying and storing brushes, the apparatus comprising:

a brush retention ring supporting a plurality of brush retainers, each brush retainer configured for retaining a handle of a brush having a bundle of bristles extending longitudinally therefrom, the plurality of brush retainers disposed about an outer periphery of the brush retention ring;

a base frame supporting a plurality of elastic sleeves, each of the elastic sleeves configured for compressing the bristles of a respective brush in a radially compressive and conforming relationship, the plurality of elastic sleeves disposed about an outer periphery of the base frame; and a support post connecting the base frame to the brush retention ring in a longitudinally spaced relationship, wherein each brush handle is retained in one of the brush retainers and the bristles thereof are engaged in the radially compressive and conforming relationship with a respective one of the elastic sleeves such that interstitial regions between the bristles are substantially closed to facilitate drying;

wherein each of the brush retainers comprises a retainer base coupled to the brush retention ring and a pair of flexible extensions defining a brush receptacle with a substantially circular cross section and a longitudinal aperture having a width smaller than a diameter of the respective brush handle, and wherein each of the brush retainers further comprises a longitudinal channel extending through a shoulder interface defined between each of the extensions and the retainer base, wherein the longitudinal channel is configured for the flexible extensions to have sufficient flexibility to accept the diameter of the brush handle within the longitudinal aperture, and to provide sufficient elastic restoring force to retain the brush handle within the brush receptacle.

11. The apparatus of claim 10, wherein the support post is configured for releasable locking engagement with the base frame and brush retention ring for selective assembly and disassembly of the apparatus in modular tower form.

12. The apparatus of claim 11, further comprising a second base frame disposed above the brush retention ring in the modular tower, and a second brush retention ring disposed above the second base frame in the modular tower.

13. The apparatus of claim 10, further comprising a cover disposed on the base frame, wherein the cover includes a central bore through which the support post extends.

14. The apparatus of claim 10, wherein the flexible extensions have end surfaces defined along radii extending from a longitudinal axis of the brush receptacle, the radii defining half-opening angles of 45±2° for the longitudinal aperture.

15. The apparatus of claim 10, wherein the elastic sleeves each comprise a tubular band formed of intercalated resilient and substantially inextensible fibers extending in circumferential and longitudinal directions, respectively, the resilient and substantially inextensible fibers cooperating for circumferential elastic expansion of the tubular band in the radially compressive and conforming relationship with the bristles while preventing substantial expansion of the tubular band in the longitudinal direction.

16. The apparatus of claim 11, wherein the brush retainers extend radially outward from the periphery of the brush retention ring.

17. A method for drying and shaping cosmetic brushes, the method comprising:

providing an apparatus for drying and storing brushes, the apparatus comprising:

a brush retention ring supporting a plurality of brush retainers having various sizes to accommodate cosmetic brushes of different sizes, each brush retainer configured for retaining a handle of a brush having a bundle of bristles extending longitudinally therefrom, the plurality of brush retainers disposed about an outer periphery of the brush retention ring;

a base frame supporting a plurality of elastic sleeves, each of the elastic sleeves configured for compressing the bristles of a respective brush in a radially compressive and conforming relationship, the plurality of elastic sleeves disposed about an outer periphery of the base frame; and a support post connecting the base frame to the brush retention ring in a longitudinally spaced relationship, wherein each brush handle is retained in one of the brush retainers and the bristles thereof are engaged in the radially compressive and conforming relationship with a respective one of the elastic sleeves such that interstitial regions between the bristles are substantially closed to facilitate drying;

wherein each of the brush retainers comprises a retainer base coupled to the brush retention ring and a pair of flexible extensions defining a brush receptacle with a substantially circular cross section and a longitudinal aperture having a width smaller than a diameter of the respective brush handle;

placing a cosmetic brush of the cosmetic brushes in one of the plurality of brush retainers, the cosmetic brush having a handle disposed in the one retainer and extending longitudinally to a bundle of bristles;

disposing one of the elastic sleeves comprising a resilient, permeable tubular band in surrounding contiguous relation to the bundle of bristles, the bristles extending longitudinally from the brush handle and defining interstitial regions therebetween;

wherein the tubular band produces an elastic restoring force acting radially inwardly against the bundle to substantially close the interstitial regions between the bristles, and to facilitate drying and shaping thereof; and wherein each of the brush retainers further comprises a longitudinal channel extending through a shoulder interface defined between each of the extensions and the retainer base, wherein the longitudinal channel is configured for the flexible extensions to have sufficient flexibility to accept the diameter of the brush handle within the longitudinal aperture, and to provide sufficient elastic restoring force to retain the brush handle within the brush receptacle.

18. The method of claim 17, further comprising releasably coupling the brush retention ring comprising a plurality of said brush retainers to the support post and releasably coupling the support post to the base frame supporting the plurality of said elastic sleeves, wherein the base frame, support post and retainer ring define a modular structure for drying and storing the cosmetic brushes.

* * * * *